US012735219B2

(12) United States Patent
Limousin

(10) Patent No.: US 12,735,219 B2
(45) Date of Patent: Sep. 15, 2026

(54) FLOW STABILIZED HIGH SPEED AXIAL FAN BLOWER FOR STRETCH WRAPPING MACHINE TAIL TREATMENT

(71) Applicant: Lantech.com, LLC, Louisville, KY (US)

(72) Inventor: Jean-Louis Limousin, Louisville, KY (US)

(73) Assignee: Lantech.com, LLC, Louisville, KY (US)

( * ) Notice: Subject to any disclaimer, the term of this patent is extended or adjusted under 35 U.S.C. 154(b) by 3 days.

(21) Appl. No.: 18/622,468

(22) Filed: Mar. 29, 2024

(65) Prior Publication Data

US 2024/0343437 A1 Oct. 17, 2024

Related U.S. Application Data

(60) Provisional application No. 63/495,610, filed on Apr. 12, 2023.

(51) Int. Cl.

| | |
|---|---|
| ***B65B 11/02*** | (2006.01) |
| ***B65B 11/04*** | (2006.01) |
| ***B65B 41/12*** | (2006.01) |
| ***B65B 51/20*** | (2006.01) |
| ***B65B 61/06*** | (2006.01) |
| ***F04D 19/00*** | (2006.01) |

(52) U.S. Cl.
CPC ..... *B65B 51/20* (2013.01); *B65B 11/025* (2013.01); *B65B 41/12* (2013.01); *B65B 61/06* (2013.01)

(58) Field of Classification Search
CPC ... B65B 11/025; B65B 11/045; F04D 19/002; F04D 25/0606; F04D 29/541; F04D 29/542; F04D 29/547; F04D 29/667
USPC ..... 53/211, 218
See application file for complete search history.

(56) References Cited

U.S. PATENT DOCUMENTS

| | | | | |
|---|---|---|---|---|
| 4,152,879 | A | 5/1979 | Shulman | |
| 4,189,894 | A | 2/1980 | Laing | |
| 4,355,496 | A | 10/1982 | Teates et al. | |
| 4,616,474 | A | 10/1986 | Morley | B65B 11/025 53/556 |
| 4,993,209 | A | 2/1991 | Halolia | |
| 4,995,224 | A | 2/1991 | Yourgalite et al. | |
| 5,005,335 | A | 4/1991 | Yourgalite et al. | |

(Continued)

FOREIGN PATENT DOCUMENTS

| | | | |
|---|---|---|---|
| AU | 2021306981 | B2 | 8/2024 |
| CA | 3185130 | A1 | 1/2022 |

(Continued)

OTHER PUBLICATIONS

Robopac USA, Genesis Futura 40 Automation Rotary Ring Stretch Wrapper-Arconvert Customer Plant, Retrieved from:https://www.youtube.com/watch?v=bg1LzR7ZuYc, Dec. 12, 2019.

(Continued)

*Primary Examiner* — Shelley M Self
*Assistant Examiner* — Patrick B Fry
(74) *Attorney, Agent, or Firm* — Gray Ice Higdon

(57) ABSTRACT

A method and load wrapping apparatus in some instances may utilize a flow stabilized high speed axial fan blower to direct a flow of fluid towards a packaging material tail to assist in adhering a packaging material tail to the side of a load at the completion of a wrapping operation.

45 Claims, 23 Drawing Sheets

(56) References Cited

U.S. PATENT DOCUMENTS

| | | | | |
|---|---|---|---|---|
| 5,787,682 | A | 8/1998 | Tolson | |
| 6,164,047 | A | 12/2000 | Rossi | |
| 6,453,643 | B1 | 9/2002 | Buscherini et al. | |
| 6,796,105 | B2 | 9/2004 | Rossi | |
| 7,007,403 | B1 * | 3/2006 | Studebaker | F26B 21/001 34/90 |
| 7,469,520 | B2 | 12/2008 | Lancaster, III et al. | |
| 8,099,935 | B2 | 1/2012 | Forni et al. | |
| 8,695,312 | B2 | 4/2014 | Johnson et al. | |
| 9,290,285 | B2 | 3/2016 | Johnson et al. | |
| 9,631,627 | B2 * | 4/2017 | Avedon | B23P 19/00 |
| 10,040,583 | B2 | 8/2018 | Smith et al. | |
| 10,227,988 | B2 * | 3/2019 | Gao | F04D 29/545 |
| 10,604,284 | B2 | 3/2020 | Pierson et al. | |
| 10,711,804 | B2 * | 7/2020 | Chen | F24F 13/28 |
| 11,794,933 | B2 * | 10/2023 | Lancaster, III | B65B 11/04 |
| 2003/0093974 | A1 | 5/2003 | Rossi | B65B 11/045 53/399 |
| 2007/0157557 | A1 * | 7/2007 | Lancaster, III | B65B 11/045 53/399 |
| 2014/0140861 | A1 * | 5/2014 | Pellenc | F04D 25/0673 417/63 |
| 2015/0203221 | A1 | 7/2015 | Van De Hey et al. | |
| 2018/0162568 | A1 | 6/2018 | Pierson | |
| 2022/0002012 | A1 * | 1/2022 | Lancaster, III | B65B 49/16 |
| 2022/0316500 | A1 * | 10/2022 | Hoffman | A01G 20/47 |
| 2024/0026980 | A1 | 1/2024 | Lancaster, III et al. | |
| 2024/0343438 | A1 | 10/2024 | Limousin | |

FOREIGN PATENT DOCUMENTS

| | | | |
|---|---|---|---|
| CN | 208565013 | U | 3/2019 |
| DE | 19509649 | A1 | 9/1996 |
| EP | 4175882 | A1 | 5/2023 |
| WO | 03020591 | A1 | 3/2003 |
| WO | 2022010654 | A1 | 1/2022 |
| WO | 2022119573 | A1 | 6/2022 |
| WO | 2024215501 | A2 | 10/2024 |

OTHER PUBLICATIONS

Wulftect, Proven Cut & Wipe Film Treatment System, Retrieved from: https://www.wulftec.com/solutions/film-tail-treatment, Retrieved on Apr. 5, 2021.

Robopac, Turntable Stretch Wrapper TECHNOPLAT 3000, Direct Industry, Retrieved from: https://www.directindustry.com/prod/robopac-spa/product-97195-1853168.html, Retrieved on Apr. 5, 2021.

Integrated Machinery, OMS Model AV620 & AV630 Stretch Wrapper, Retrieved from: https://integratedmachinery.com.au/wp-content/uploads/2017/10/OMS_Model_AV620_and_AV630_Automated_Rotary_Arm_Stretch_Wrapper.pdf, Retrieved on Apr. 5, 2021.

International Search Report and Written Opinion issued in PCT Application No. PCT/US2021/038776, dated Sep. 29, 2021, 18 pages.

US Patent and Trademark Office, Notice of Allowance issued in U.S. Appl. No. 17/356,426 dated Jun. 14, 2023.

US Patent and Trademark Office, Office Action issued in U.S. Appl. No. 17/356,426 dated Feb. 3, 2023.

Patent Cooperation Treaty; Invitation to Pay Additional Fees in International Patent Application No. PCT/US2024/022354; 11 pages; dated Sep. 10, 2024.

Patent Cooperation Treaty; International Search Report and Written Opinion Issued in PCT Application No. PCT/US2024/022354; 17 pages; dated Oct. 31, 2024.

Australian Government—IP Australia; Examination Report No. 1 issued in Application No. 2021306981; 4 pages Jan. 16, 2024.

Australian Government—IP Australia; Examination Report No. 2 issued in Application No. 2021306981; 6 pages; dated May 17, 2024.

United States Patent & Trademark Office; Non-Final Office Action filed in U.S. Appl. No. 18/473,744; 31 pages; dated Dec. 17, 2024.

European Patent Office; Extended Search Report issued in European Application No. 21836805.8; 6 pages; dated Jul. 2, 2024.

European Patent Office; Communication Pursuant to Rules70(2) and 70a(2); issued in application No. 21836805.8; 1 page; dated Jul. 19, 2024.

United States Patent & Trademark Office; Non-Final Office Action filed in U.S. Appl. No. 18/622,510; 45 pages; dated Jun. 3, 2025.

United States Patent & Trademark Office; Non-Final Office Action filed in U.S. Appl. No. 18/622,510 ; 50 pages; dated Jun. 3, 2025.

United States Patent & Trademark Office; Final Office Action filed in U.S. Appl. No. 18/622,510; 46 pages; dated Nov. 25, 2025.

* cited by examiner

FLOW STABILIZED HIGH SPEED AXIAL FAN BLOWER FOR STRETCH WRAPPING MACHINE TAIL TREATMENT

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

Loads have been wrapped with packaging material by securing a leading end portion of the packaging material to the load or a turntable clamp, dispensing the packaging material, and providing relative rotation between the load and a packaging material dispenser to cause the load to be enveloped by the packaging material. The relative rotation may be provided several different ways. Either the load can be rotated on a turntable, or the dispenser can be rotated around the stationary load. Wrapping usually employs a web of packaging material as the packaging material.

Semi-automatic wrapping machinery generally requires an operator to attach a leading end portion of the packaging material to the load prior to wrapping. This is typically accomplished by collapsing the leading end portion into a rope, then inserting the rope between the layers of the load or tying the end of the packaging material to the edge of the supporting wood pallet or any suitable outcropping on the load. This attachment must be relatively strong since it provides the resistance to pulling the packaging material from the packaging material dispenser during the initiation of the relative rotation between the load and the packaging material dispenser. The attachment or tying of the packaging material makes packaging material removal more difficult after the load has been shipped to its destination.

Automatic wrapping machines typically use packaging material clamps that grip the packaging material web between two opposed surfaces and use electrical or pneumatic actuators to open and close the clamps. Such packaging material clamps may create a "tenting" effect during wrapping due to the distance between the clamp and the load during wrapping, resulting in wasted packaging material and loosely wrapped loads. In addition, such clamps are generally expensive and may require costly maintenance for the electrical and mechanical actuators.

In addition, many wrapping machines integrate packaging material cutters that sever the web of packaging material at the end of a wrapping operation and once the packaging material has been gripped by a clamp. Furthermore, a wipe down mechanism is generally used to press the "tail" of packaging material that remains attached to the load once the web is severed. Conventional wipe down mechanisms utilize a reach arm that either pops up from a retracted position or swings inwardly from a position outside of the wrap zone (or zone of rotation), and many generally employ plastic loops that wipe across the side of the load to adhere the packaging material tail to the side of the load. In some instances, the movement of the load itself, e.g., on a conveyor once the wrapping operation is complete, may be used to move the load past a stationary wipe down mechanism.

Conventional wipe down mechanisms, however, are often relatively complex and may be difficult to incorporate into some applications, including, for example, applications where a load is supported on the ground rather than on a conveyor or turntable. Furthermore, some wipe down mechanisms can produce inconsistent results, with tails that are inadequately adhered to the side of the load. Such unadhered tails, however, can be problematic during later transportation and storage as they can present a snagging hazard for fork trucks and other load racking devices.

Attempts have also been made to direct airflow at a tail to improve adherence to the side of the load. However, it has been found that such attempts may not generate airflow of a sufficient velocity to have a meaningful effect on the tail's adherence to the side of the load, or if sufficient velocity is generated, the turbulence induced during the process can lead to inconsistent results, with tails folding over and/or twisting prior to adherence to the side of the load.

Therefore, a significant need continues to exist in the art for an improved manner of adhering a packaging material tail to a load at the completion of a wrapping operation.

SUMMARY OF THE INVENTION

The invention addresses these and other problems associated with the art by providing in one aspect a method and apparatus that in some instances may utilize a flow stabilized high speed axial fan blower to assist in adhering a packaging material tail to the side of a load at the completion of a wrapping operation.

Therefore, consistent with one aspect of the invention, an apparatus for wrapping a load may include a packaging material dispenser configured to dispense a web of packaging material to the load, a rotational drive configured to generate relative rotation between the packaging material dispenser and the load about a center of rotation, a cutting assembly configured to sever the web of packaging material to form a packaging material tail extending from a corner of the load, and a flow stabilized high speed axial fan blower positioned to direct a flow of fluid towards the packaging material tail from a position generally upstream of a free end of the packaging material tail and at an acute angle relative to the side of the load while the free end of the packaging material tail is unsupported to cause the packaging material tail to come into contact with the side of the load. The flow stabilized high speed axial fan blower may be configured to generate the flow of fluid to have, proximate the corner of the load, a velocity of at least about 10 miles per hour throughout a target area defined in a plane generally transverse to a longitudinal axis of the flow stabilized high speed axial fan blower.

In some embodiments, the target area has a height that is at least about a height of the packaging material tail proximate the corner of the load. Also, in some embodiments, the flow stabilized high speed axial fan blower is configured to generate the flow of fluid to have, proximate a center of the target area, a velocity of at least about 20 miles per hour, and proximate a perimeter of the target area, a velocity of at least about 10 miles per hour. Further, in some embodiments, the flow stabilized high speed axial fan blower is configured to generate the flow of fluid to have a velocity of at least about 50 miles per hour proximate an outlet of the flow stabilized high speed axial fan blower.

In some embodiments, the flow stabilized high speed axial fan blower is inclined upwardly at least about 8 degrees. In addition, in some embodiments, the flow stabilized high speed axial fan blower is inclined upwardly at least about 16 degrees. In some embodiments, the flow stabilized high speed axial fan blower is positioned such that the target area extends at least about 3 inches on each side of the corner of the load.

Some embodiments may also include a rotating arm, where the packaging material dispenser is coupled to the rotating arm and the rotational drive is configured to generate the relative rotation between the packaging material dispenser and the load about the center of rotation by rotating the rotating arm about the center of rotation, and a base supporting the rotating arm, where the flow stabilized high speed axial fan blower is mounted to the base. In some embodiments, the base includes at least one leg and a bollard disposed proximate an end of the at least one leg, and the flow stabilized high speed axial fan blower is mounted within the bollard.

In addition, some embodiments may also include a turntable for supporting the load, and the rotational drive is configured to generate the relative rotation between the packaging material dispenser and the load about the center of rotation by rotating the turntable. Moreover, in some embodiments, the flow stabilized high speed axial fan blower is mounted to a support leg disposed proximate the turntable.

In some embodiments, the acute angle is a first angle, the position is a first position, the flow of fluid is a first flow of fluid, and the apparatus further includes a flow device configured to direct a second flow of fluid towards the packaging material tail from a second position and at a second angle relative to the side of the load. Moreover, in some embodiments, the flow device includes one or more nozzles coupled to a source of pressurized fluid. In some embodiments, the one or more nozzles are rotatably supported by a support assembly that is at least partially inside of a zone of rotation for the packaging material dispenser to rotate between a substantially horizontal storage position and a substantially vertical operating position. In addition, in some embodiments, the second angle is substantially orthogonal relative to the side of the load, the flow device is configured to be activated after the flow stabilized high speed axial fan blower is activated, and the flow device is configured to be activated concurrently with the packaging material tail coming into contact with the side of the load.

In some embodiments, the flow stabilized high speed axial fan blower includes a housing extending along the longitudinal axis between an inlet and an outlet, an axial fan blade disposed in the housing and configured to rotate about the longitudinal axis, a fan motor coupled to the axial fan blade and configured to rotate the axial fan blade about the longitudinal axis at a rate at or greater than about 10,000 RPM, and a plurality of stabilizing vanes extending between the axial fan blade and the outlet of the housing and configured to stabilize fluid flow downstream of the axial fan blade.

Moreover, in some embodiments, the housing is substantially cylindrical and has a length to width ratio between about 1.5 to 1 and about 4 to 1. Also, in some embodiments, the axial fan blade includes 8 to 15 blades. In some embodiments, the fan motor is configured to rotate the axial fan blade at a rate at or greater than about 20,000 RPM. In addition, in some embodiments, the fan motor is configured to rotate the axial fan blade at a rate at or greater than about 40,000 RPM. Also, in some embodiments, the fan motor is a variable speed DC motor.

Moreover, in some embodiments, the plurality of stabilizing vanes includes four stabilizing vanes. Further, in some embodiments, each of the plurality of stabilizing vanes includes a leading edge disposed proximate the axial fan blade and a trailing edge disposed proximate the outlet of the housing such that the plurality of stabilizing vanes extend substantially throughout a space between the axial fan blade and the outlet of the housing. Also, in some embodiments, each of the plurality of stabilizing vanes includes a curved leading edge that curves in a direction opposite of a direction of rotation of the axial fan blade.

Further, in some embodiments, the blower further includes an inner housing extending along the longitudinal axis within the outer housing, and the plurality of stabilizing vanes are coupled to the inner housing. In some embodiments, the inner housing is substantially cylindrical. Also, in some embodiments, the inner housing includes an open end facing the inlet of the outer housing and at least a portion of the fan motor is received within the open end of the inner housing. In some embodiments, the blower further includes a flared inlet. Further, in some embodiments, a leading end of the axial fan blade is substantially even with a narrower diameter end of the flared inlet.

Consistent with another aspect of the invention, an apparatus for wrapping a load may include a packaging material dispenser configured to dispense a web of packaging material to the load, a rotational drive configured to generate relative rotation between the packaging material dispenser and the load about a center of rotation, a cutting assembly configured to sever the web of packaging material to form a packaging material tail extending from a corner of the load, and a flow stabilized high speed axial fan blower positioned to direct a flow of fluid towards the packaging material tail from a position generally upstream of a free end of the packaging material tail and at an acute angle relative to the side of the load while the free end of the packaging material tail is unsupported to cause the packaging material tail to come into contact with the side of the load. The flow stabilized high speed axial fan blower may also include a housing extending along a longitudinal axis between an inlet and an outlet, an axial fan blade disposed in the housing and configured to rotate about the longitudinal axis, a fan motor coupled to the axial fan blade and configured to rotate the axial fan blade about the longitudinal axis at a rate at or greater than about 10,000 RPM, and a plurality of stabilizing vanes extending between the axial fan blade and the outlet of the housing and configured to stabilize fluid flow downstream of the axial fan blade.

In some embodiments, the housing is substantially cylindrical and has a length to width ratio of between about 1.5 to 1 and about 4 to 1. Further, in some embodiments, the axial fan blade includes 8 to 15 blades. Also, in some embodiments, the fan motor is configured to rotate the axial fan blade at a rate at or greater than about 20,000 RPM. In addition, in some embodiments, the fan motor is configured to rotate the axial fan blade at a rate at or greater than about 40,000 RPM. In some embodiments, the fan motor is a variable speed DC motor.

In addition, in some embodiments, the plurality of stabilizing vanes includes four stabilizing vanes. Also, in some embodiments, each of the plurality of stabilizing vanes includes a leading edge disposed proximate the axial fan blade and a trailing edge disposed proximate the outlet of the housing such that the plurality of stabilizing vanes extend substantially throughout a space between the axial fan blade and the outlet of the housing. In addition, in some embodiments, each of the plurality of stabilizing vanes includes a curved leading edge that curves in a direction opposite of a direction of rotation of the axial fan blade.

In some embodiments, the blower further includes an inner housing extending along the longitudinal axis within the outer housing, and the plurality of stabilizing vanes are coupled to the inner housing. Further, in some embodiments, the inner housing is substantially cylindrical. In addition, in some embodiments, the inner housing includes an open end facing the inlet of the outer housing and at least a portion of the fan motor is received within the open end of the inner housing. Further, in some embodiments, the blower further includes a flared inlet. Moreover, in some embodiments, a leading end of the axial fan blade is substantially even with a narrower diameter end of the flared inlet.

Consistent with another aspect of the invention, an apparatus for wrapping a load may include a packaging material dispenser configured to dispense a web of packaging material to the load, a rotational drive configured to generate relative rotation between the packaging material dispenser and the load about a center of rotation, a cutting assembly configured to sever the web of packaging material to form a packaging material tail extending from a corner of the load, and a flow stabilized high speed axial fan blower positioned to direct a flow of fluid towards the packaging material tail. The flow stabilized high speed axial fan blower may include a housing extending along a longitudinal axis between an inlet and an outlet, an axial fan blade disposed in the housing and configured to rotate about the longitudinal axis, a fan motor coupled to the axial fan blade and configured to rotate the axial fan blade about the longitudinal axis at a rate at or greater than about 10,000 RPM, and a plurality of stabilizing vanes extending between the axial fan blade and the outlet of the housing and configured to stabilize fluid flow downstream of the axial fan blade.

Some embodiments may further include a controller coupled to the rotational drive and the flow stabilized high speed axial fan blower, and the controller may be configured to activate the flow stabilized high speed axial fan blower a first time to direct a first flow of fluid towards the packaging material tail from a position generally upstream of a free end of the packaging material tail and at an acute first angle relative to the side of the load while the free end of the packaging material tail is unsupported to cause the packaging material tail to come into contact with the side of the load, activate the rotational drive to rotate the load relative to the flow stabilized high speed axial fan blower, and after rotation of the load relative to the flow stabilized high speed axial fan blower, activate the flow stabilized high speed axial fan blower a second time and at a second angle relative to the side of the load to increase adherence of the packaging material tail to the side of the load.

Consistent with another aspect of the invention, a method of wrapping a load may include dispensing a web of packaging material to the load with a packaging material dispenser and generating relative rotation between the packaging material dispenser and the load about a center of rotation to wrap the web of packaging material around the load, severing the web of packaging material to form a packaging material tail extending from a corner of the load, and directing a flow of fluid towards the packaging material tail from a position generally upstream of a free end of the packaging material tail and at an acute angle relative to the side of the load while the free end of the packaging material tail is unsupported to cause the packaging material tail to come into contact with the side of the load using a flow stabilized high speed axial fan blower. The flow stabilized high speed axial fan blower may be configured to generate the flow of fluid to have, proximate the corner of the load, a velocity of at least about 10 miles per hour throughout a target area defined in a plane generally transverse to a longitudinal axis of the flow stabilized high speed axial fan blower.

In some embodiments, the flow of fluid is a first flow of fluid and the acute angle is a first angle, and the method further includes rotating the load relative to the flow stabilized high speed axial fan blower, and after rotation of the load relative to the flow stabilized high speed axial fan blower, activating the flow stabilized high speed axial fan blower at a second angle relative to the side of the load to increase adherence of the packaging material tail to the side of the load.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Figure 1:
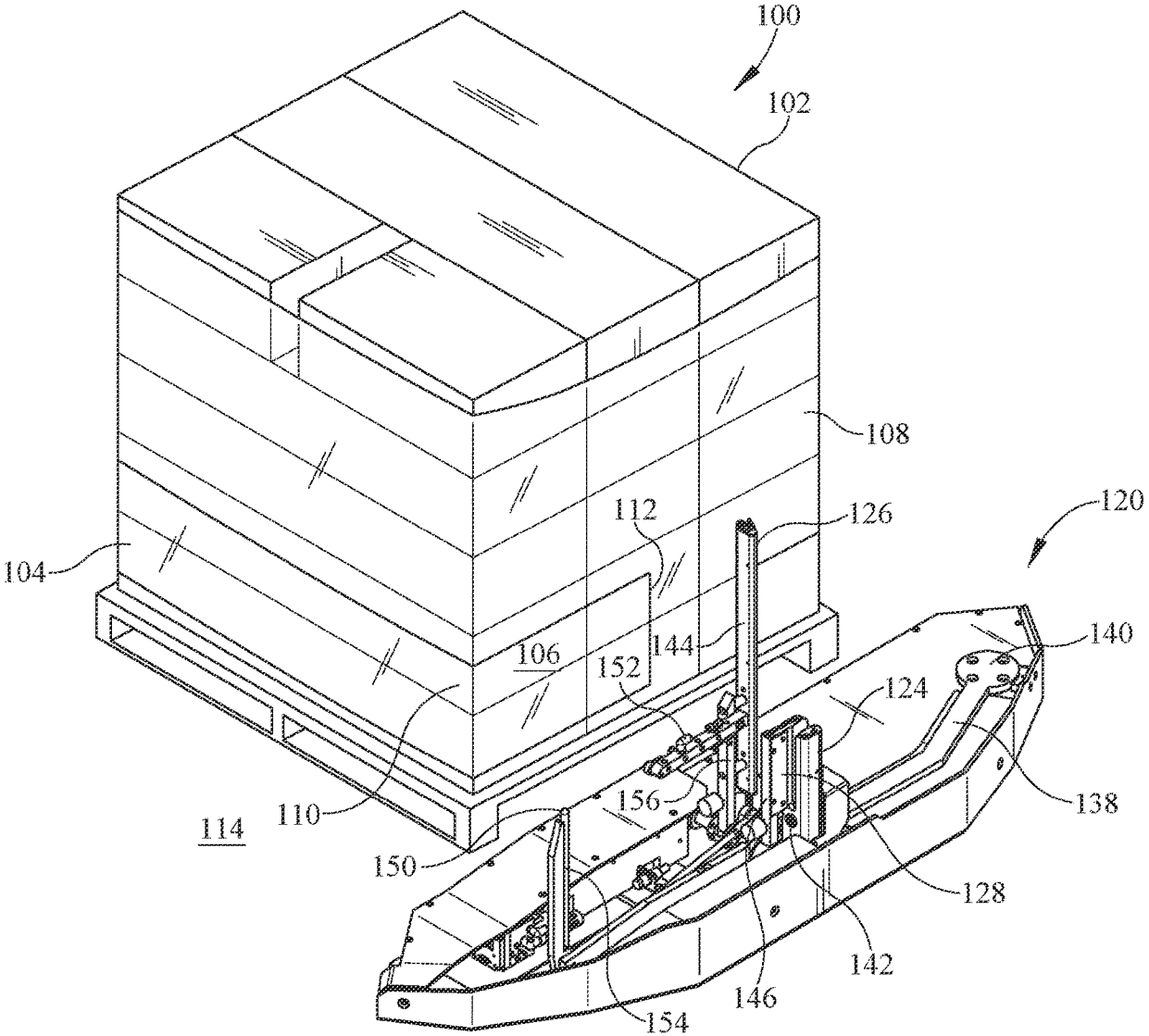
FIG. 1 shows a perspective view of a rotating arm-type wrapping apparatus consistent with the invention.

Embodiments consistent with the invention may utilize in some aspects a flow stabilized high speed axial fan blower to direct pressurized fluid flow upstream from a packaging material tail and/or in two or more directions to assist in adhering the packaging material tail to the side of a load at the completion of a wrapping operation. In this regard, a packaging material tail generally refers to a portion of a web of packaging material that extends between a load and a packaging material dispenser at the completion of a wrapping operation, and generally the portion of the web that extends between a last corner of the load around which the web of packaging material is wrapped and a cutting assembly that severs the web of packaging material at the completion of the wrapping operation. In addition, as will become more apparent below, embodiments consistent with the invention may also utilize a flow device disposed downstream of a wrap position at which the load is wrapped to direct a flow of fluid towards a packaging material tail to increase adherence of the packaging material tail to the side of a load after the load has been wrapped and conveyed away from the wrap position.

A packaging material tail may, in many instances, be shorter in length than the width of the side of the load to which it adheres, and it is generally desirable to adhere the packaging material tail to the side of the load to minimize the risk that the packaging material tail will detach from the load. An improperly adhered tail, for example, may detract from the visual appearance of the load, and can also potentially result in a snagging hazard, e.g., capable of snagging on a fork truck, a shelf, a truck trailer, or any other structures that a load may encounter during transportation and/or storage.

It will be appreciated that the packaging material used in a stretch wrapping machine is generally formed of a polymer material having some degree of stickiness, particularly between overlapping layers of the packaging material. Thus, to optimize the adherence of the packaging material tail to the load, it is generally desirable to lay the packaging material tail over a portion of the load that is already wrapped with packaging material, and to do so with as little bunching of the packaging material tail (both across its width and along its length) as is feasible to maximize the surface area overlapped by the packaging material tail.

In some embodiments consistent with the invention, pressurized fluid flow is emitted in multiple directions to both inhibit bunching of the packaging material tail prior to the packaging material tail engaging with the side of the load (e.g., during the time period between the web of packaging material being severed and coming into contact with side of the load) and to further adhere the packaging material tail to the side of the load. The pressurized fluid flow may, for example, be forced air or another gas, and may be generated, for example, using a fan, a blower, a compressor or another source of pressurized and/or compressed fluid. In some embodiments, and as will be discussed in greater detail below, the pressurized fluid flow may be generated by a flow stabilized high speed axial fan blower. Moreover, the pressurized fluid flow emitted in different directions may be emitted from different distances, from different positions, at different pressures, at different volumes, at different velocities and/or over different time periods.

In some instances, the pressurized fluid flow may occur in multiple stages, and may be directed in multiple directions, to inhibit bunching of the packaging material and/or improve adherence of the packaging material to the side of the load. In some particular instances, a pressurized fluid such as air may be directed in two directions during two different stages.

In a first stage, pressurized fluid may be directed from an upstream position relative to the free end of the packaging material tail and in a first direction that forms an acute angle relative to a plane of the web of packaging material prior to severing the web, with the first stage occurring proximate in time to the severing of the web, e.g., slightly before, slightly after, or simultaneously therewith. It may be desirable in some embodiments for the flow to be higher volume but lower velocity than the second stage, with the goal being to at least temporarily "fill" the packaging material tail in a similar manner to a sail or flag and lay the packaging material tail over the side of the load. By filling the packaging material tail as it lays over the side of the load, bunching of the packaging material tail both across its width and along its length is desirably reduced, thereby increasing the surface area of the load overlapped by the packaging material tail, increasing the adhesion of the packaging material tail to the side of the load, and providing a visually pleasing appearance.

In some embodiments, this lower velocity but higher volume flow may be generated by a flow stabilized high speed axial fan blower, as discussed in greater detail below, and in some embodiments, a flow stabilized high speed axial fan blower that is disposed outside of a wrap zone (or zone of rotation) for a stretch wrapping machine, and may be used to effectively transport the free end of the packaging material tail from a first position where it is initially cut (in many cases in a plane extending between the packaging material dispenser and the corner of the load) to a second position against the side of the load, while maintaining the packaging material tail in a substantially open or spread out state, and such that the tail, once adhered to the side of the load, has a generally "flat" appearance, with minimal wrinkling or bunching. It is also generally desirable to do so using a blower positioned outside of the zone of rotation for a packaging material dispenser in non-turntable applications, which may, in some instances may be a distance greater than about 30 inches, and in some instances, a distance greater than about 40 to about 45 inches.

It should also be note that when a web is severed, the web is generally under tension, so the packaging material tail formed once the web is severed is generally subject to a restoring force that in the absence of any fluid flow will tend to cause the packaging material tail to "spring back" and bunch up lengthwise. Thus, the first stage fluid flow may also be suitable for opposing this restoring force and resisting lengthwise bunching of the packaging material tail as it lays onto the side of the load.

In a second stage, pressurized fluid may be directed from a relatively closer position to the load and in a second direction that is generally orthogonal to the side of the load, with the second stage occurring proximate in time to the packaging material tail coming into contact with the side of the load, e.g., slightly before, slightly after, or simultaneously therewith. In some instances, the second stage may also occur well after the packaging material tail comes into contact with the side of the load. In some embodiments, it may be desirable for the second stage flow to be relatively higher velocity but lower volume than the first stage, and generally with a shorter duration. In addition, the second stage flow may include multiple pulses or blasts, at either the same location or at multiple locations across the width of the packaging material tail, with the goal being to effectively press the packaging material tail against the side of the load to increasing adherence of the packaging material tail to the packaging material wrapped around the load.

In other embodiments, pressurized fluid flow may only be used in a single stage, e.g., directed from an upstream position relative to the free end of the packaging material tail and in a direction that forms an acute angle relative to a side of the load, or in some instances, an acute angle relative to a plane of the web of packaging material prior to severing the web, with the single stage occurring proximate in time to the severing of the web, e.g., slightly before, slightly after, or simultaneously therewith. In such embodiments, the single stage fluid flow may provide sufficient adherence of the packaging material tail to the side of the load, although in other embodiments, it may be desirable to mechanically contact the packaging material tail to press the packaging material tail against the side of the load once the packaging material tail has come into contact with the side of the load. The mechanical contact may be provided, for example, by a finger, a pad, a brush or another mechanism capable of pressing, wiping, or smoothing the packaging material tail against the side of the load.

It will be appreciated that embodiments consistent with the invention generally are utilized in connection with a trailing packaging material tail that extends between a last corner of the load around which the web of packaging material is wrapped and a cutting assembly that severs the web of packaging material at the completion of the wrapping operation, rather than with any unsupported section of packaging material forming a leading end of the packaging material that may extend between a temporary from a first corner of a load and a clamp that initially holds the web of packaging material at the start of a wrapping operation performed by some types of stretch wrapping machines. Blasts of air have been used for the latter application for the purpose of blowing the unsupported section of packaging material against the side of the load so that subsequent wraps will cover up this unsupported section; however, such blasts have generally been performed predominantly upwardly from a location beneath a conveyor supporting the load and alongside the side of the load. Similar blasts of air, from a similar position and in a similar predominantly upward orientation have also been used in connection with a mechanical contact mechanism. Embodiments consistent with the invention, in contrast, may direct one or more fluid flows at a trailing packaging material tail from different positions and orientations as described above to improve the adhesion of the packaging material tail to the side of the load and/or improve the appearance of the adhered packaging material tail on the load.

Now turning to the drawings, wherein like numbers denote like parts throughout the several views, FIGS. 1-7 illustrate an apparatus 100 for wrapping a load 102 with packaging material 104, as well as for performing a packaging material tail treatment operation to secure a packaging material tail 106 to a side 108 of load 102. As illustrated in FIG. 1, packaging material tail 106 generally extends from a corner 110 and terminates at a free end 112, and desirably is substantially free of bunching in a lengthwise direction (horizontal in FIG. 1) and a widthwise direction (vertical in FIG. 1) to maximize the surface area of packaging material tail 106 that overlaps side 108, and thereby optimizes adherence of the packaging material tail to the side of the load.

In the illustrated embodiment, apparatus 100 is a rotating arm-type wrapping apparatus, and moreover, is configured to wrap loads that are placed directly on a floor 114. In other embodiments, however, apparatus 100 may be a turntable-type wrapping apparatus or a vertical or horizontal ring-type apparatus, and furthermore, apparatus 100 may be configured to wrap loads supported on various types of load supports, e.g., turntables, conveyors, platforms, floors, etc.

Apparatus 100 may include a support assembly 120, also referred to as a cut and clamp assembly, positioned adjacent a load and configured to both position a leading end of a packaging material web against load 102 at the start of a wrapping operation and sever a trailing end of the packaging material web wrapped around load 102 at the end of a wrapping operation. Further, as discussed above, apparatus 100 is additionally capable of performing a packaging material tail treatment operation such that, when the trailing end of the packaging material web is severed, the packaging material tail formed thereby is secured to the side of the load.

Support assembly 120 may include a base 122, a packaging material holder 124 for selectively holding and releasing (or engaging and disengaging) a leading end portion of a packaging material web, a cutting assembly 126 for severing the packaging material web, and an insertion tool 128 for urging the web of packaging material into an opening 130 disposed between first and second opposing jaws 132, 134 of packaging material holder 124. One or more bladders or inflatable elements 136 are disposed between second opposing jaws 132, 134 and are convertible between first, unpressurized conditions defining a gap within opening 130, and second, pressurized conditions closing the gap to thereby clamp the web of packaging material in opening 130 when packaging material is received in opening 130.

Cutting assembly 126 may be used to sever the packaging material while the web of packaging material is engaged by holder 124, and may, in some embodiments, be implemented using a hot wire that melts the packaging material when current is passed through the wire and the packaging material comes into contact with the wire. In other embodiments, however, other cutting assemblies, e.g., using knives or sharp edges, may be used.

Packaging material holder 106 is movable between a first position adjacent the side of the load (illustrated in FIG. 3) and a second position (illustrated in FIGS. 1-2) away from the side of the load, and in the illustrated embodiment, such movement is provided via a support arm 138 that rotates about a substantially vertical axis extending through hub 140. Holder 106 is positioned in the first position during wrapping such that packaging material is wrapped over at least a portion of the holder, and as such, holder 106 includes a rotatable hinged wrist portion 142 that enables the holder to be pulled out from under the packaging material wrapped around the load when moved from the first position to the second position at the conclusion of wrapping packaging material around the load.

Figure 2:
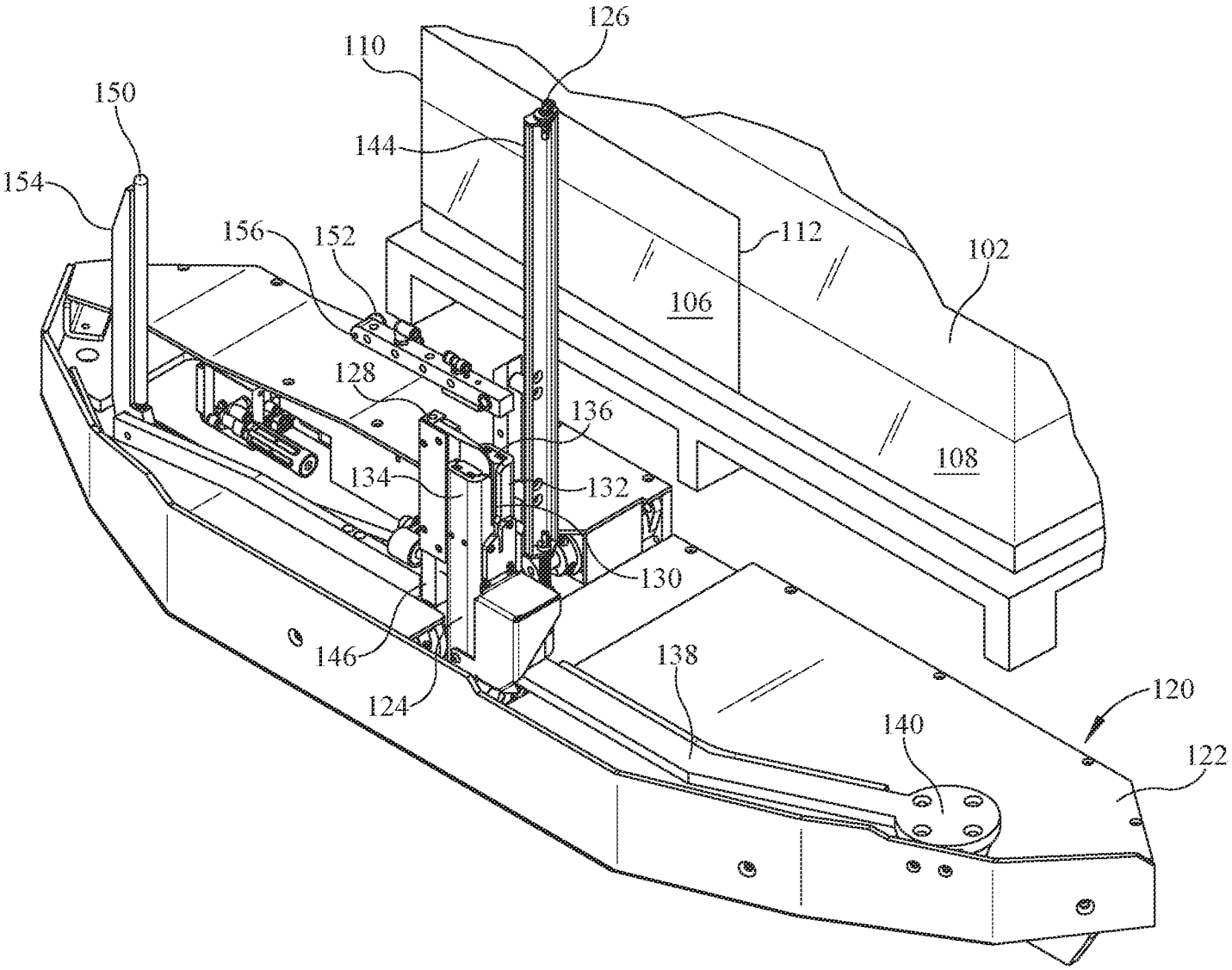
FIG. 2 is an enlarged partial perspective view of the apparatus of FIG. 1.

In the illustrated embodiment, support assembly 120 is at least partially inside of a zone of rotation for a packaging material dispenser of apparatus 100 (not shown in FIGS. 1-2). Moreover, in some positions (e.g., when wrapping around the pallet or the bottom of the load) little clearance is available between the packaging material dispenser and floor 114, so it may be desirable to configure support assembly 120 as a low profile assembly and to incorporate retractable components into the support assembly to reduce the height of the support assembly during at least portions of a wrapping operation.

For example, in the illustrated embodiment, each of cutting assembly 126 and insertion tool 128 are rotatably supported on respective arms 144, 146 to rotate between respective substantially horizontal storage positions (illustrated, for example, in FIG. 3) and respective substantially vertical operating positions (illustrated, for example, in FIGS. 1-2). Movement of arms 144, 146 may be controlled via pneumatic or hydraulic actuators, by electric drives, or in other appropriate manners.

Support assembly 120 may otherwise be configured in various manners, e.g., as disclosed in U.S. Pat. No. 8,695,312, which is assigned to the same assignee as the present application, and which is incorporated by reference herein.

In addition, support assembly 120 further includes first and second flow devices 150, 152 that are respectively supported on arms 154, 156 and that are similarly retractable as cutting assembly 126 and insertion tool 128, whereby each flow device 150, 152 is movable between a respective substantially horizontal storage position (illustrated, for example, in FIG. 3) and a respective substantially vertical operating position (illustrated, for example, in FIGS. 1-2). Movement of arms 154, 156 may be controlled via pneumatic or hydraulic actuators, by electric drives, or in other appropriate manners.

First flow device 150 is disposed at a first position that is generally upstream of free end 112 of packaging material tail 106 and includes one or more nozzles oriented to direct a first flow of fluid towards packaging material tail 106 at a first angle relative to the side of the load. Similarly, second flow device 152 is disposed at a second position that is generally closer to the side of the load than the first position, and includes one or more nozzles oriented to direct a second flow of fluid towards packaging material tail 106 at a second angle relative to side 108 of load 102. As will become more apparent below, the first angle is smaller than the second angle, and in some embodiments, the first angle is acute relative to the side of the load. In some instances, the first angle is less than about 45 degrees relative to the side of the load, and in some instances, the first angle is less than about 30 degrees relative to the side of the load. Further, in some embodiments, the first angle is acute relative to a plane extending between corner 110 of load 102 and cutting assembly 126. Moreover, in some embodiments, the second angle is substantially orthogonal relative to side 108 of load 102. Further, in some embodiments, the elevation of each of flow devices 150, 152 is also desirably at a similar elevation to that of tail 106 such that both flows of fluid are substantially horizontal relative to floor 114. In some embodiments, it may be desirable to orient one or both of flow devices 150, 152, to direct their flows of fluid at a somewhat upward angle to compensate for the downward gravitational force due to the weight of the packaging material in the tail, as it is generally desirable for tail 106 to lay over the side 108 of load 102 substantially horizontally. It will be appreciated that, from the perspective of the flows of fluid, substantially horizontally may be considered in some embodiments to include a flow of fluid where at least one axis of flow (e.g., an axis defined by a nozzle of a flow device) is substantially horizontal (e.g., within about +/−10 degrees of a horizontal plane). It may also be desirable in some embodiments for a flow of fluid to be at least predominantly horizontal, which in the context of this disclosure maybe considered to be a flow of fluid in which the majority of the fluid flow is less than about 45 degrees from a horizontal plane.

Each flow device 150, 152 may be implemented in a number of manners, and may be coupled to a source of pressurized fluid, e.g., a fan, a blower, a compressor, a pressurized hose, etc. Each flow device 150, 152 may include one or more nozzles, and each nozzle may have different flow characteristics, e.g., in terms of exit velocity, flow volume, stream width, etc. suitable for providing desired fluid flow at each of the first and second positions. A flow device may also incorporate an air amplifier or air knife, and may generate fluid flow of various sizes, cross-sections, etc.

In some embodiments, for example, flow device 150 may be configured to generate fluid flow having a rate of about 9 to about 15 miles per hour, and in some embodiments, a rate of about 11 to about 13 miles per hour. In addition, the cross-section of the fluid flow emitted by flow device 150 may desirably be about 18 inches in height and about 12 to about 14 inches in width in the plane extending between corner 110 and cutting assembly 126 (which also generally corresponds to the plane of a packaging material web 160 as presented to the cutting assembly 126), with the height generally selected to be less than or equal to the height of the packaging material web 160 as presented to the cutting assembly 126, and with the width generally selected to be sufficient to accommodate loads 102 of differing dimensions (given that the location of corner 110 will necessarily depend upon the length, width and/or offset of the load relative to support assembly 120.

Figure 3:
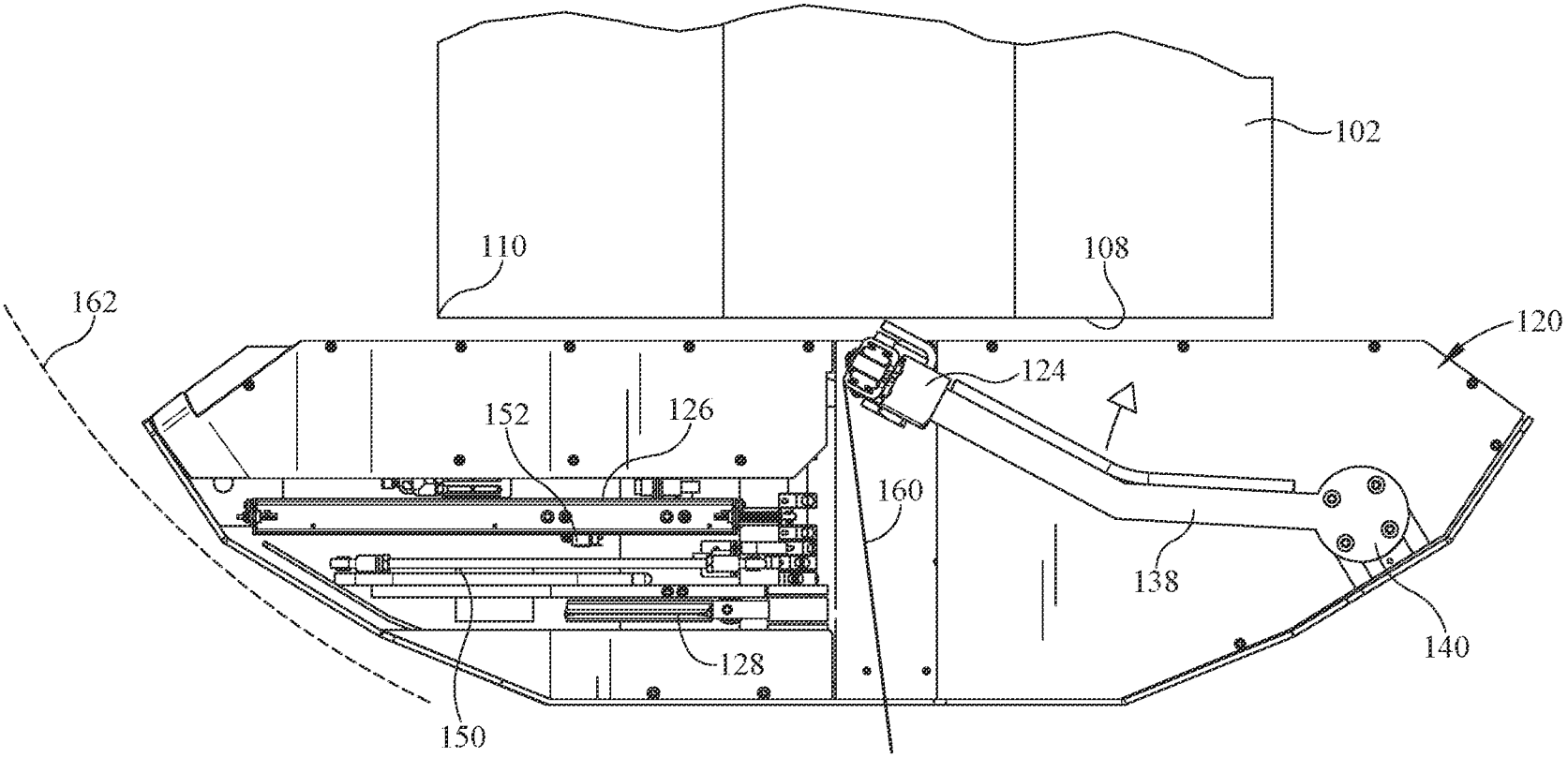
FIG. 3 is an enlarged partial top plan view of the apparatus of FIG. 1, illustrating a start of a wrapping operation.
Figure 6:
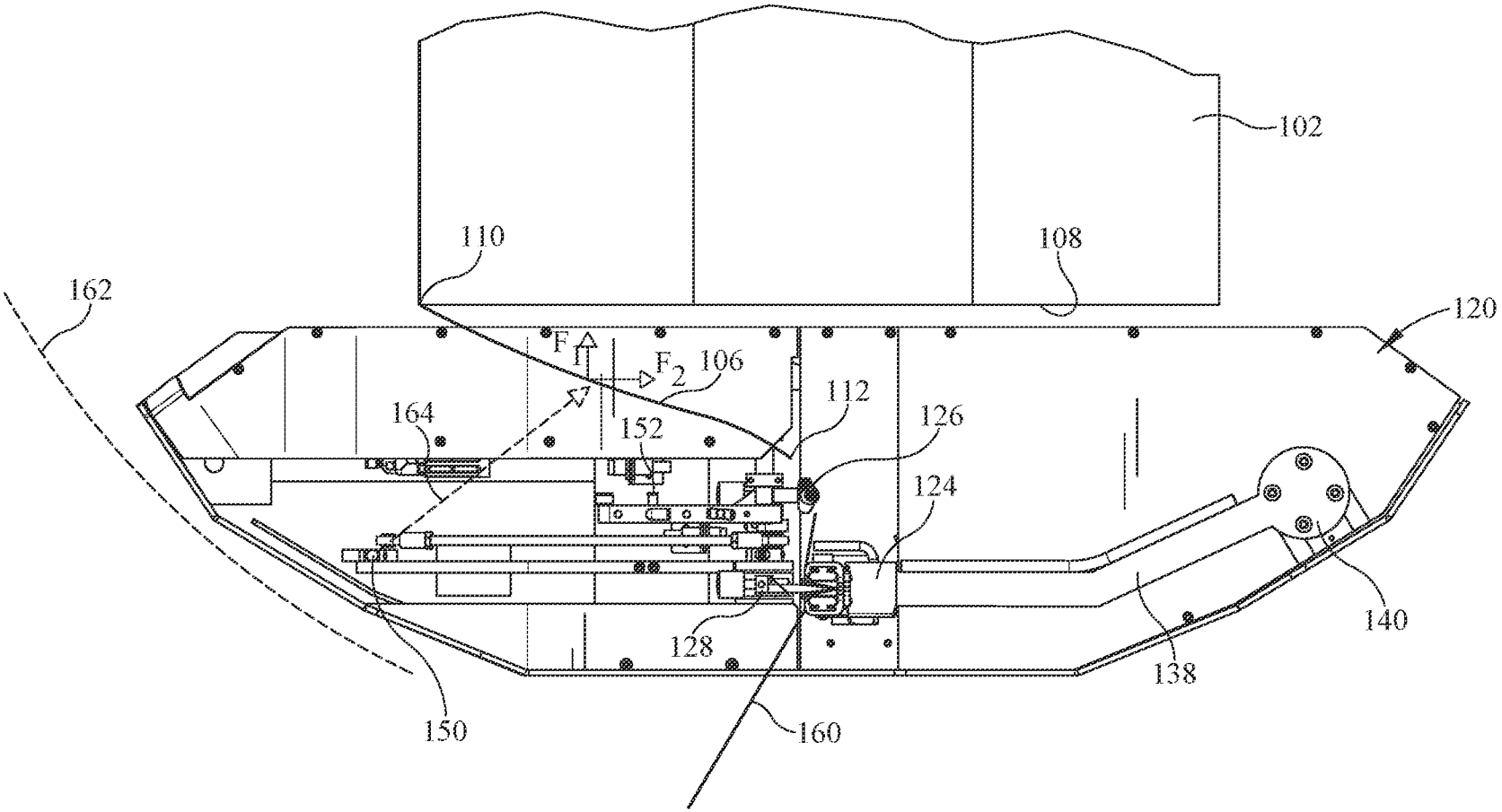
FIG. 6 is an enlarged partial top plan view of the apparatus of FIG. 1, illustrating a first stage of a tail treatment operation performed in connection with severing the packaging material web at the end of the wrapping operation.
Figure 7:
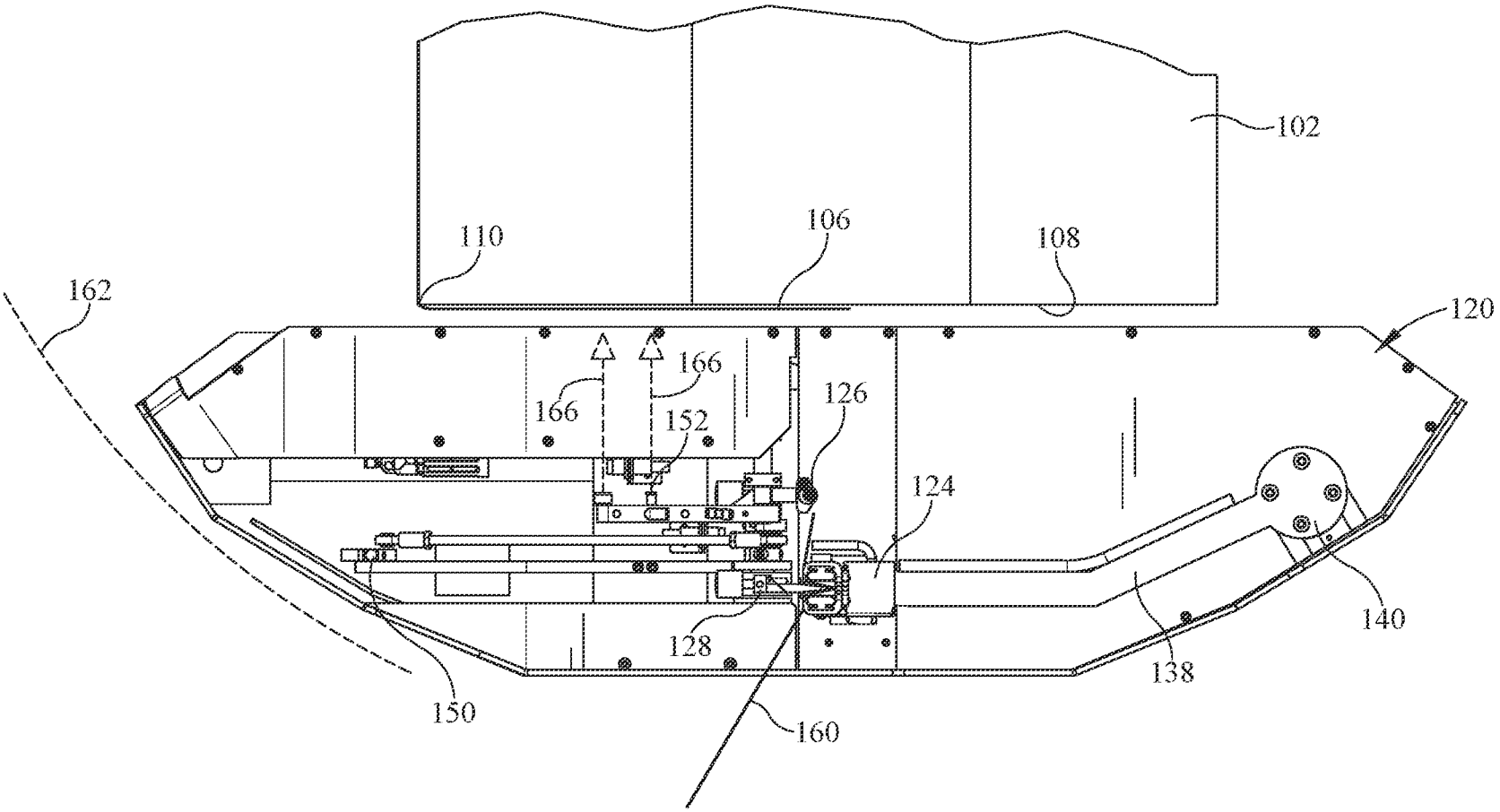
FIG. 7 is an enlarged partial top plan view of the apparatus of FIG. 1, illustrating a second stage of the tail treatment operation performed in connection with severing the packaging material web at the end of the wrapping operation.
Figure 8:
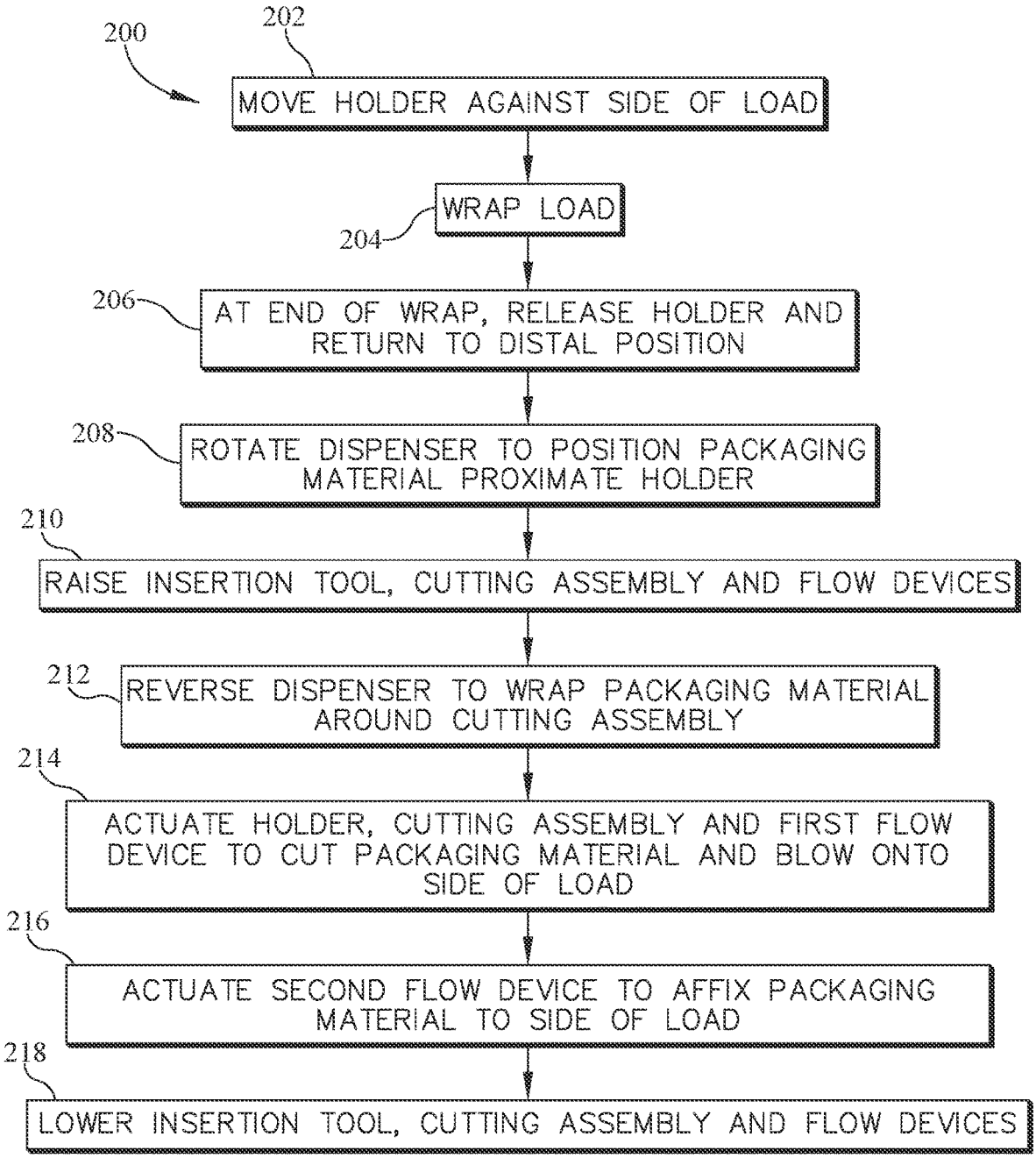
FIG. 8 is a flowchart illustrating an example sequence of operations for wrapping a load using the apparatus of FIGS. 1-7.

Now turning to FIG. 8, and with continuing reference to FIGS. 1-7, a sequence of operations 200 for wrapping a load using apparatus 100 is described in greater detail. In particular, as illustrated in FIG. 3, when a wrapping operation is first initiated a leading end of a packaging material web 160 is engaged by holder 124. Moreover, each of cutting assembly 126, insertion tool 128, first flow device 150 and second flow device 152 are initially in their substantially horizontal storage positions such that wrapping can occur proximate the bottom of the load free of obstruction from any of these components.

First, in block 202, holder 124 is rotated from the second position to the first position adjacent side 108 of load 102, as illustrated in FIG. 3. Wrapping then commences in block 204, with rotation of a packaging material dispenser (not shown in FIG. 3) around a zone of wrapping represented by arc 162 (FIG. 3).

Figure 4:
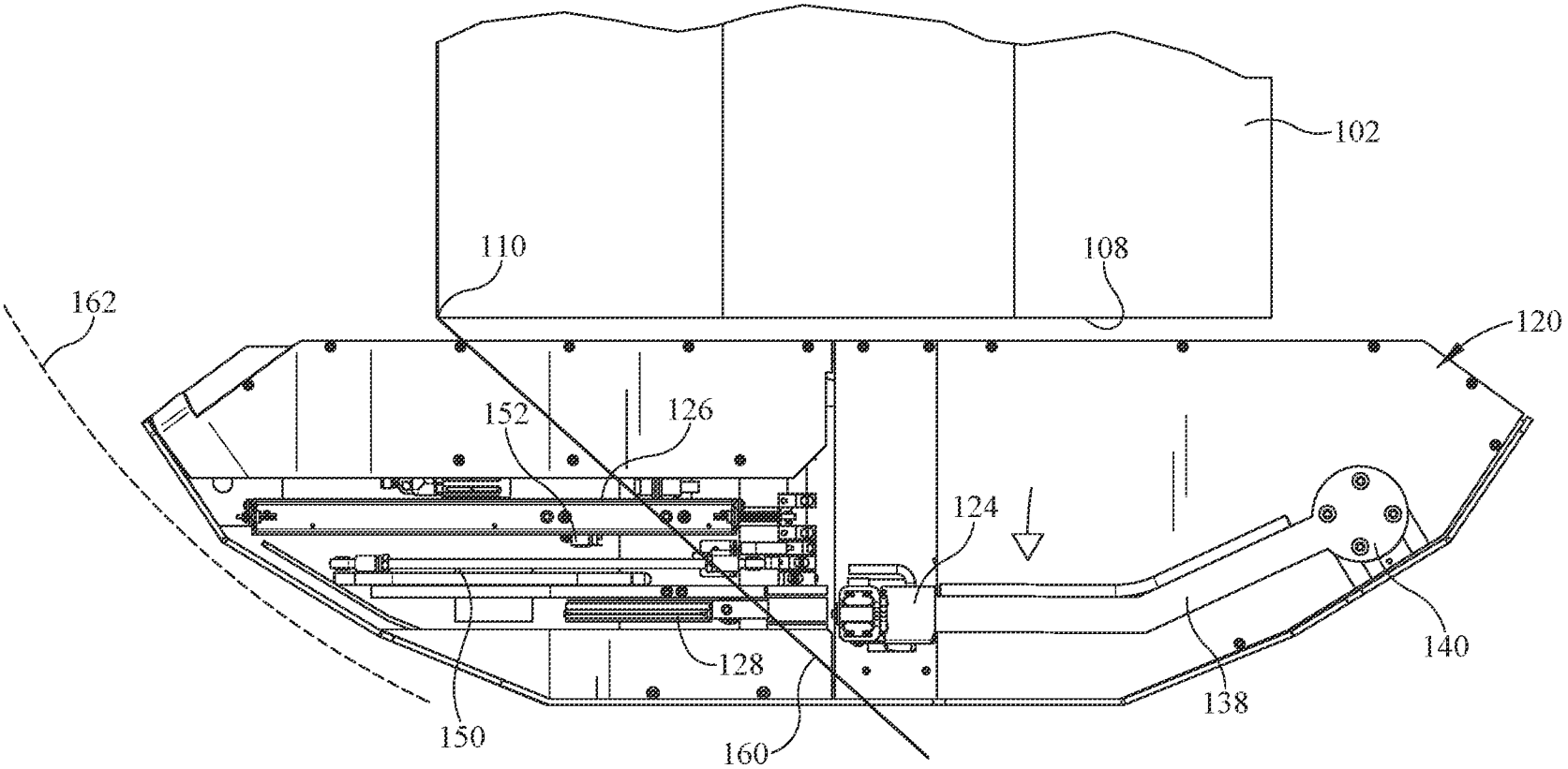
FIG. 4 is an enlarged partial top plan view of the apparatus of FIG. 1, illustrating placement of a packaging material web prior to severing the packaging material web at an end of the wrapping operation.

Next, as illustrated in FIG. 4, at the conclusion of wrapping, holder 124 may be released and returned to its second (distal) position (block 206) and the packaging material dispenser may be rotated to a position that orients packaging material web 160 proximate holder 124 (block 208).

Figure 5:
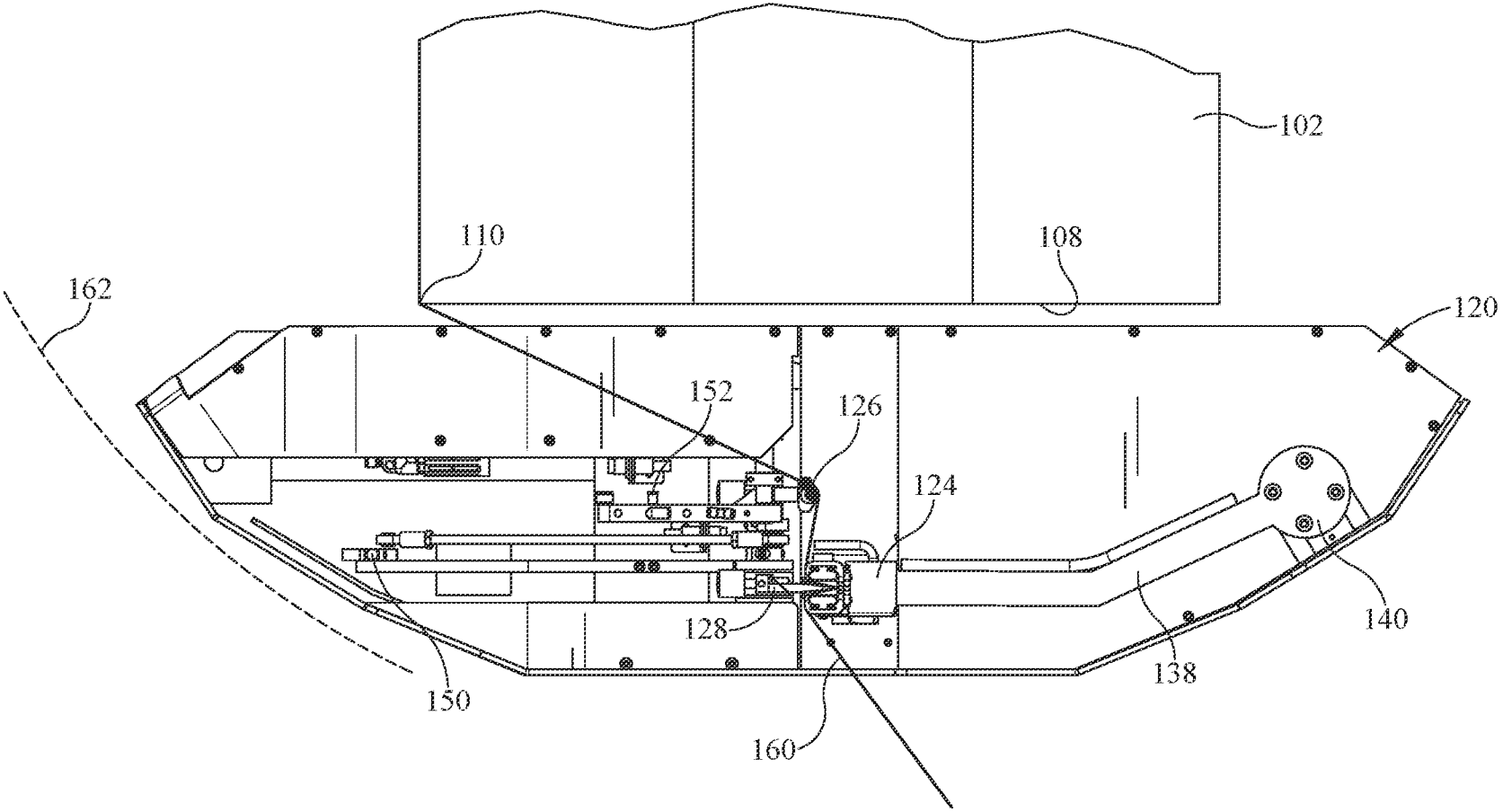
FIG. 5 is an enlarged partial top plan view of the apparatus of FIG. 1, illustrating extension of a cutting assembly, an insertion tool, and first and second flow devices prior to severing the packaging material web at the end of the wrapping operation.

Next, as illustrated in FIG. 5, cutting assembly 126, insertion tool 128 and flow devices 150, 152 are raised to their respective vertical operating positions (block 210), with insertion tool 128 urging the packaging material web into the opening of holder 124 and with the web wrapping around cutting assembly 126.

Next, as illustrated in FIG. 6, the packaging material dispenser may be reversed to further wrap the web around cutting assembly 126 (block 212). Moreover, holder 124 may be actuated to engage the packaging material web, cutting assembly 126 may be actuated to sever the web and form packaging material tail 106, and first flow device 150 may be actuated to blow or urge packaging material tail 106 onto side 108 of load 102 (block 214). As noted above, first flow device 150 directs a flow of fluid in a direction represented by arrow 164, which, in the illustrated embodiment, is acute relative to side 108, as well as acute relative to the plane extending between corner 110 and cutting assembly 126. The timing of the actuations may vary in different embodiments, e.g., with first flow device 150 being actuated either prior to, concurrently with, or after severing of the web with cutting assembly 156, such that a flow of fluid is directed onto packaging material tail 106 while the free end 112 thereof is unsupported.

It should be noted that, as a result of the acute angle at which the flow of fluid is directed, the fluid flow imparts both a force component $F_1$ that urges the packaging material tail 106 toward side 108 of load 102, as well as a force component $F_2$ that resists lengthwise bunching of the tail and opposes the restoring force resulting from severing of the web while under tension by cutting assembly 156.

Next, as illustrated in FIG. 7, second flow device 152 is actuated to direct a flow of fluid in a direction represented by arrows 166 (block 216). Doing so increases adhesion of the packaging material tail to the side of the load, and in this regard, it may be desirable to generate flow in the form of multiple air pulses or blasts, e.g., two air pulses or blasts separated by one or more seconds. It may also be desirable to direct air pulses or blasts at multiple locations across the length and/or width of the packaging material tail to improve adhesion at the multiple locations.

Finally, returning to FIG. 8, once the packaging material tail is adhered or affixed to the side of the load, cutting assembly 156, insertion tool 158 and flow devices 150, 152 may be lowered to their respective storage positions, with apparatus 100 in suitable condition for another wrapping operation to wrap a different load.

Figure 9:
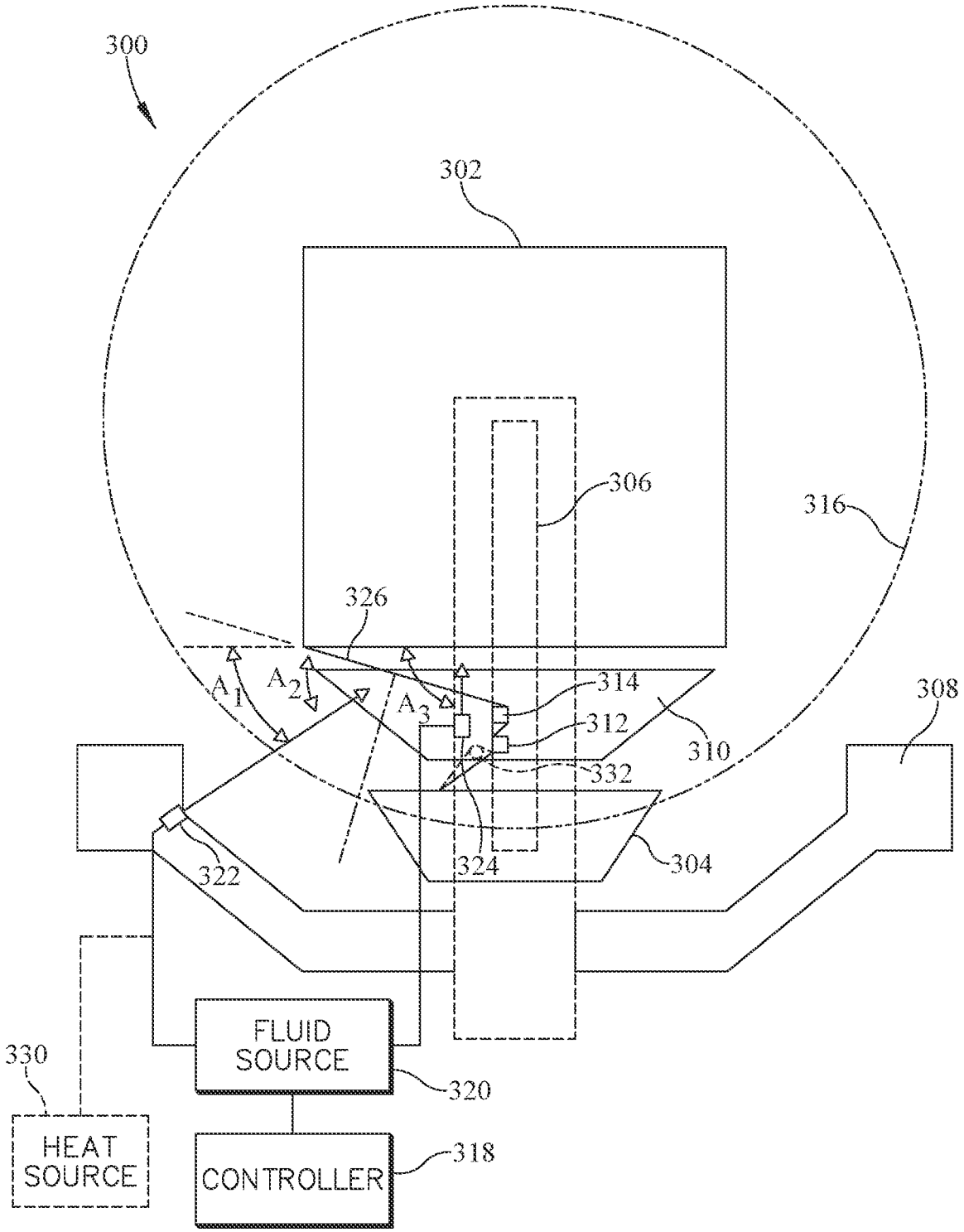
FIG. 9 is a functional top plan view of another wrapping apparatus consistent with the invention, and utilizing an alternate location for a first stage flow device to that illustrated in FIGS. 1-7.

Now turning to FIG. 9, another implementation of a load wrapping apparatus 300 for wrapping a load 302 is shown. Apparatus 300 includes a packaging material dispenser 304 that is supported by a rotating arm 306, which is supported on a base 308. A support assembly 310, similar in some respects to support assembly 120, includes a holder 312 and cutting assembly 314, and a zone of rotation is represented by circle 316.

A controller 318, which is capable of operating the various components of apparatus 300, is coupled to a fluid source 320 that drives first and second flow devices 322, 324. As noted above, each flow device 322, 324 may be positioned in various locations and supported by various structures in different embodiments, and FIG. 9 illustrates one such alternate location for flow device 322, which is outside of zone of rotation 316 and supported on base 322. A flow device may be supported on other portions of apparatus 300, including, for example, other locations on base 308 or even on packaging material dispenser 304. In addition, a flow device may be free standing or supported by other structures, e.g., on a conveyor frame, a turntable frame, etc.

FIG. 9 also illustrates suitable flow directions for flow devices 322, 324. Angle $A_1$, for example, illustrates the direction of flow from flow device 322 relative to the side of load 302, while angle $A_2$ illustrates the direction of flow from flow device 322 relative to a plane 326 extending between a corner of the load and cutting assembly 314, and it will be appreciated that in the example of FIG. 9, both angles $A_1$ and $A_2$ are acute. Similarly, for flow device 324, $A_3$ illustrates a direction of flow that is relative to the side of the load, and that, in this example, is substantially orthogonal to the side of the load. Other locations and directions may be used in other embodiments.

As also mentioned above, in other embodiments, only a single stage operation may be used, e.g., to perform a first stage operation as described herein from any of the various positions and/or directions described herein (e.g., using either of the positions of flow device 150 or flow device 322). As such, in some embodiments, flow device 324 may be omitted. Moreover, in some embodiments, a single stage operation may be followed by mechanically contacting the packaging material tail to press the packaging material tail against the side of the load to increase the adhesion of the packaging material tail thereto, and as such, flow device 324 may be replaced with a finger, a pad, a brush, etc.

In still other embodiments, a flow device such as flow device 322 may be used to perform both a first stage and a second stage, where between the first and second stages, the load is rotated relative to flow device 322 (e.g., when supported on a turntable, such as on a turntable-type wrapping apparatus), such that rotation of the load orients flow device 322 to a position relative to the rotated side of the load that directs a second fluid flow at the side of the load with an angle similar to that of flow device 324, e.g., angle $A_3$ discussed above, which in some embodiments may be substantially orthogonal to the side of the load.

In still other embodiments, it may be desirable to heat at least a portion of the packaging material tail prior to contact with the side of the load to further improve adherence of the packaging material tail. In some embodiments, the heat may be supplied to the packaging material from one or more of the fluid flows, e.g., using a fluid source 320 including an integrated heat source capable of providing a heated fluid, or by injecting heated air into one or more of the fluid flows, e.g., using an optional heat source 330 that is separate from the fluid source 320 as illustrated in FIG. 9. The optional heat source 330 in some embodiments may provide heated fluid that is combined with the fluid from fluid source 320, while in other embodiments optional heat source 330 may heat fluid from fluid source 320 prior to the fluid being supplied to a flow device 322, 324.

In still other embodiments, the heat may be supplied to the packaging material via direct contact, e.g., via a roller or other surface over which the packaging material passes. FIG. 9, for example, illustrates an optional heated roller 332 that may be permanently in contact with the web of packaging material in some embodiments (and optionally activated only at the end of a wrapping operation). In other embodiments, however, the heated roller may selectively engage the packaging material web at the end of a wrapping operation, e.g., by tilting or moving upward into the path of a packaging material web from a storage position similar to holder 312 and cutting assembly 314 of support assembly 310 such that the packaging material web portion corresponding to the tail is passed over the heated roller 332 prior to being severed by cutting assembly 314 and contacting the side of the load.

Regardless of whether fluid-based heating and/or direct contract-based heating is used, however, the application of heat at the end of a wrapping operation may increase the adherence of the packaging material tail to the side of the load in some embodiments of the invention. It will be appreciated, however, that the use of heat is optional, and may not be utilized in other embodiments.

Controller 318 in the embodiment illustrated in FIG. 9 is a local controller that is physically co-located with the various components illustrated in the figure. Controller 318 may include hardware components and/or software program code that allow it to receive, process, and transmit data. It is contemplated that controller 318 may be implemented as a programmable logic controller (PLC), or may otherwise operate similar to a processor in a computer system. Controller 318 may communicate with an operator interface, which may include a display or screen and controls that provide an operator with a way to monitor, program, and operate apparatus 300. For the purposes of the invention, controller 318 may represent practically any type of computer, computer system, controller, logic controller, or other programmable electronic device, and may in some embodiments be implemented using one or more networked computers or other electronic devices, whether located locally or remotely with respect to the various components illustrated in FIG. 9. Controller 318 typically includes a central processing unit including at least one microprocessor coupled to a memory, which may represent the random access memory (RAM) devices comprising the main storage of controller 318, as well as any supplemental levels of memory, e.g., cache memories, non-volatile or backup memories (e.g., programmable or flash memories), read-only memories, etc. In addition, the memory may be considered to include memory storage physically located elsewhere in controller 318, e.g., any cache memory in a processor, as well as any storage capacity used as a virtual memory, e.g., as stored on a mass storage device or on another computer or electronic device coupled to controller 318. Controller 318 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 318 may include an interface with one or more networks (e.g., a LAN, a WAN, a wireless network, and/or the Internet, among others) to permit the communication of information to the components in apparatus 300 as well as with other computers and electronic devices, e.g., computers such as a desktop computer or laptop computer, mobile devices, multi-user computers such as servers or cloud resources, etc. Controller 318 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 318, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 318. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Controller 318 for the purposes of this example is assumed to be incorporated wholly within components that are local to wrapping apparatus 300. It will be appreciated, however, that in other embodiments, at least a portion of the functionality incorporated into a wrapping apparatus may be implemented in hardware and/or software that is external to the aforementioned components. For example, in some embodiments, some user interaction may be performed using an external device such as a networked computer or mobile device, with the external device converting user or other input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations described herein may be implemented by various local and/or remote components and combinations thereof in different embodiments.

Flow Stabilized High Speed Axial Fan Blower

Figure 10:
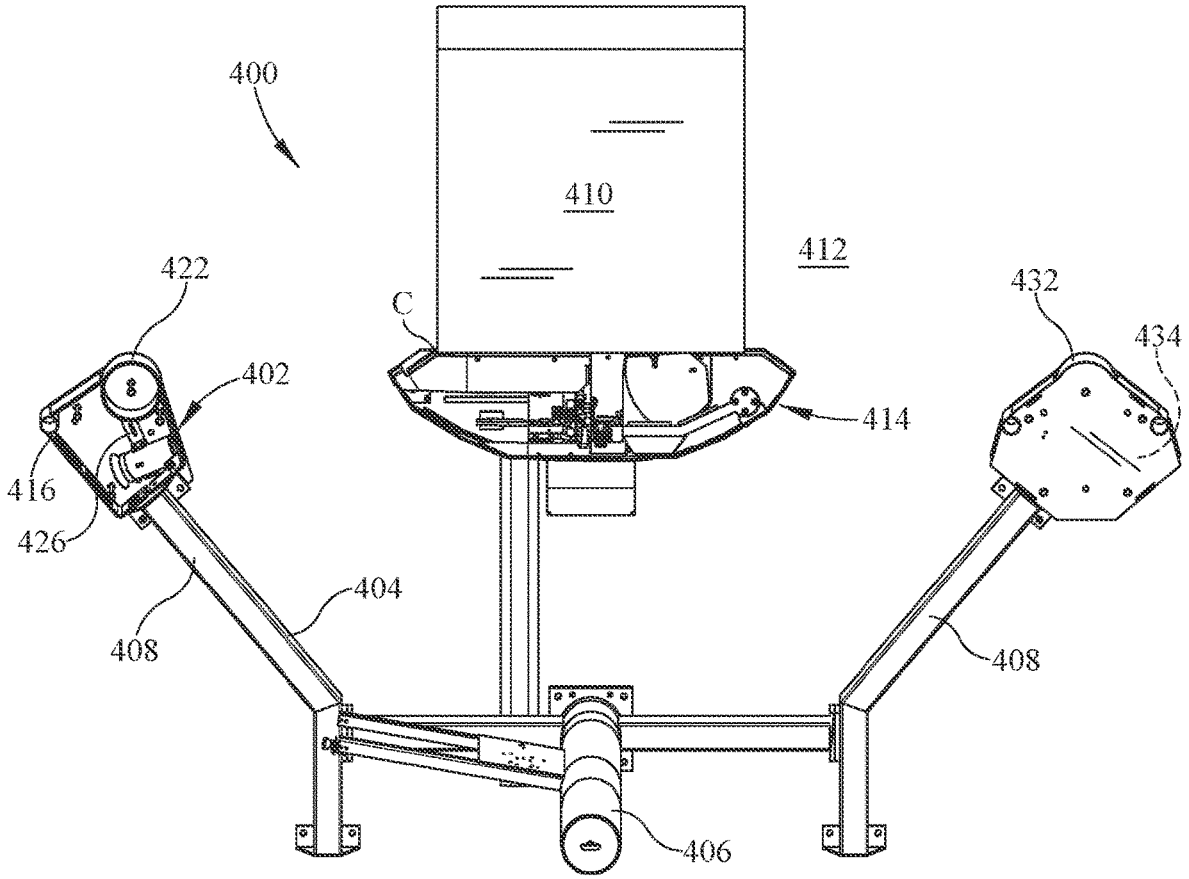
FIG. 10 is a top perspective view of a portion of a load wrapping apparatus including a flow stabilized high speed axial fan blower consistent with some embodiments of the invention.
Figure 11:
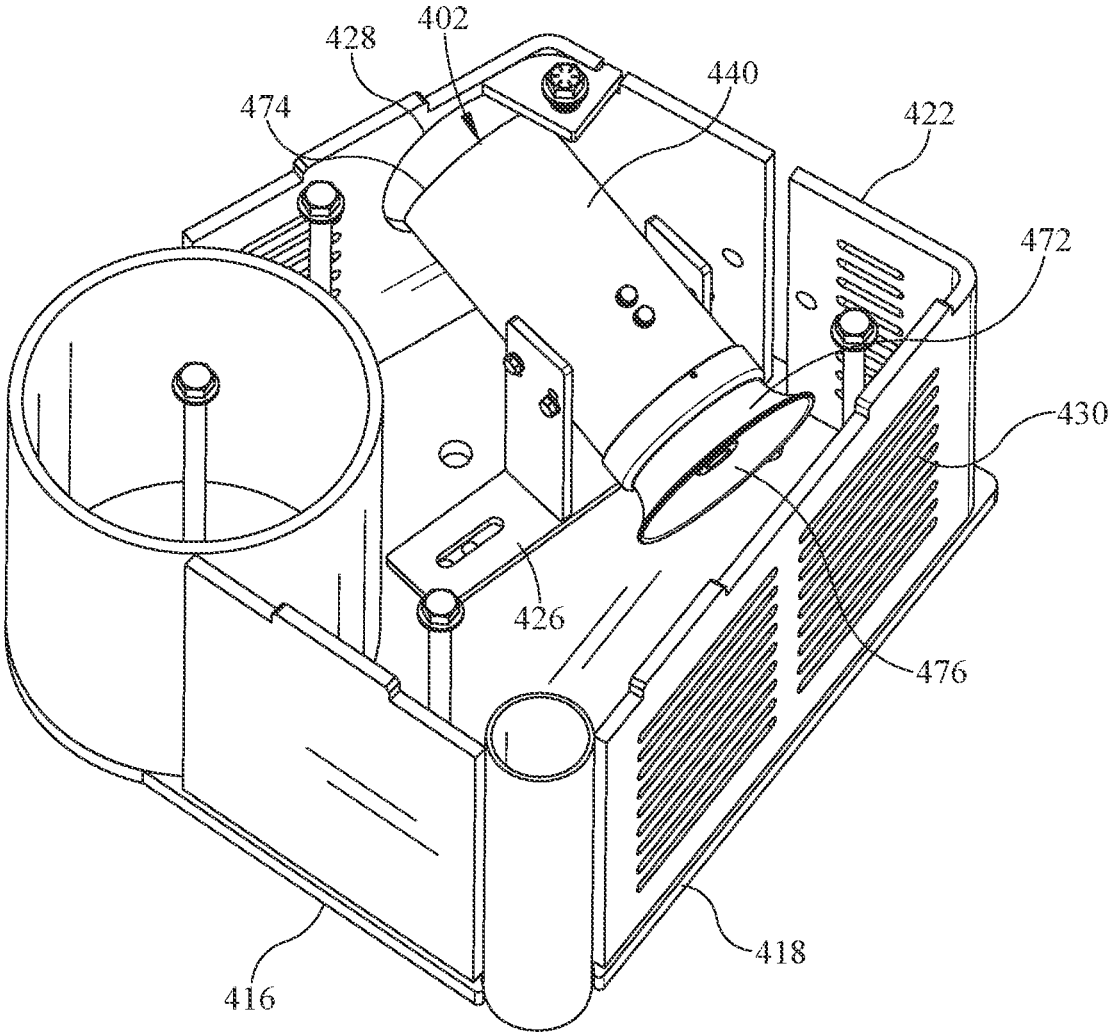
FIG. 11 is a side perspective view of one of the bollards of the load wrapping apparatus of FIG. 10, with a top plate of the bollard removed.
Figure 12:
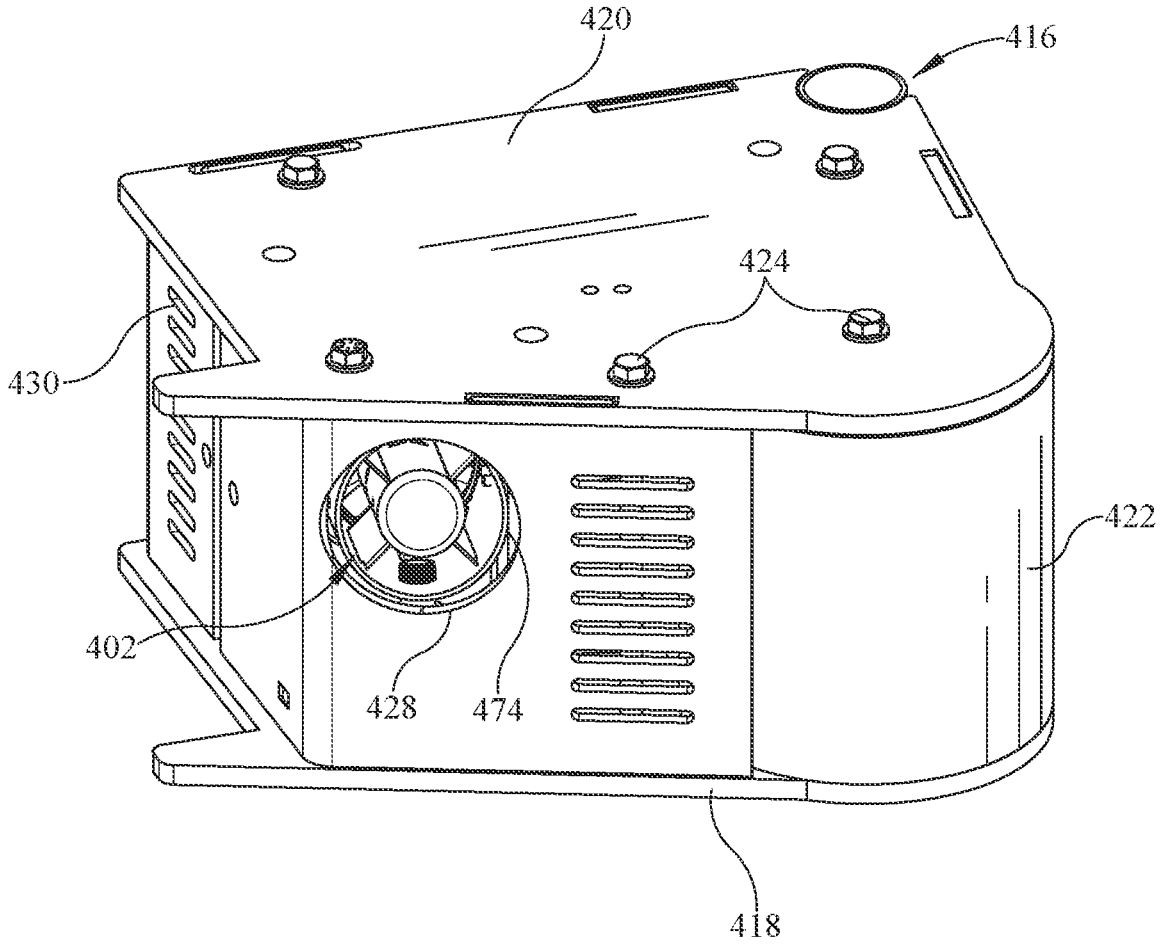
FIG. 12 is another side perspective view of the bollard of FIG. 11.
Figure 13:
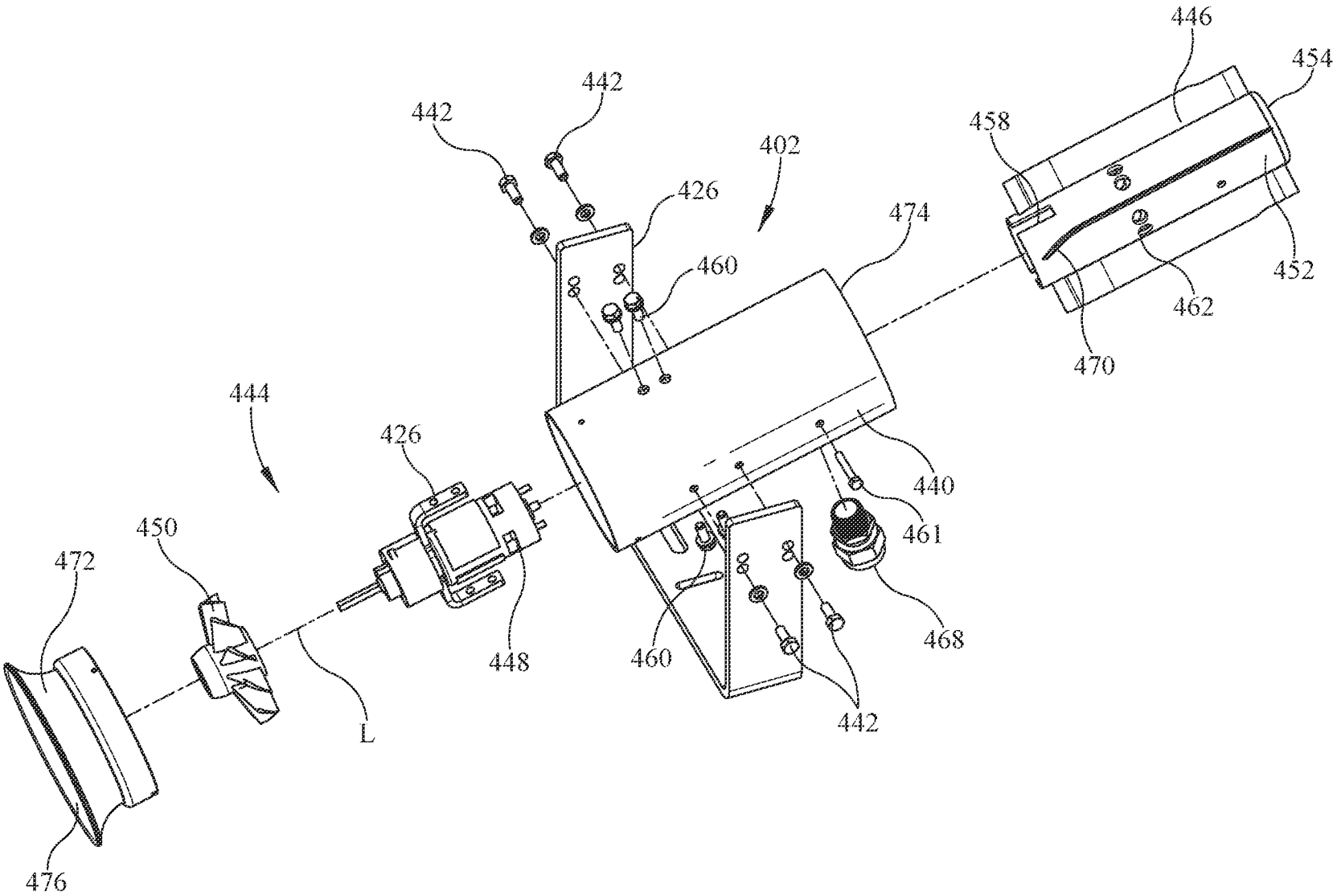
FIG. 13 is an exploded perspective view of the blower and mounting bracket of FIGS. 10-12.
Figure 14:
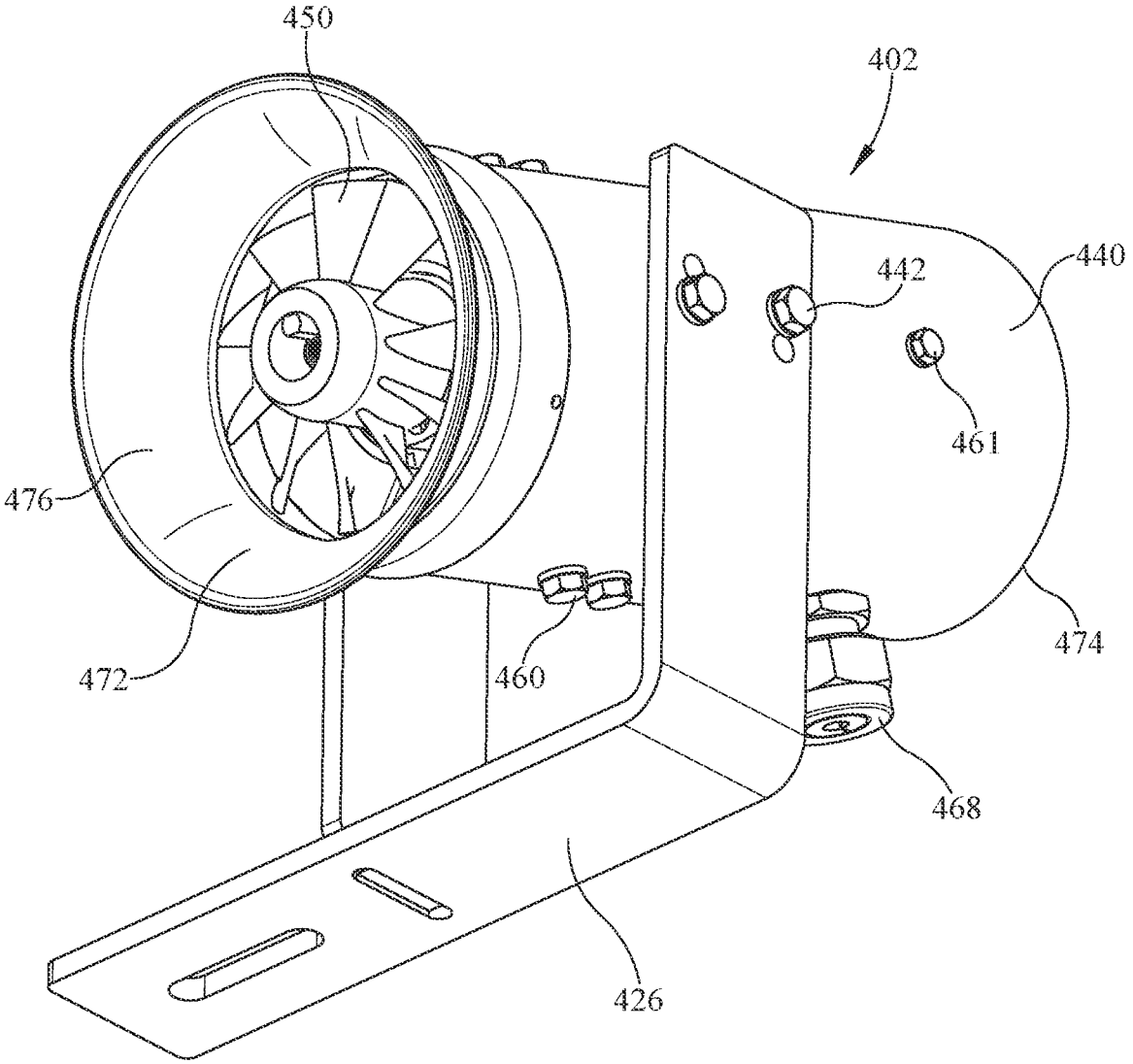
FIG. 14 is a lower side perspective view of the blower and mounting bracket of FIG. 13.
Figure 15:
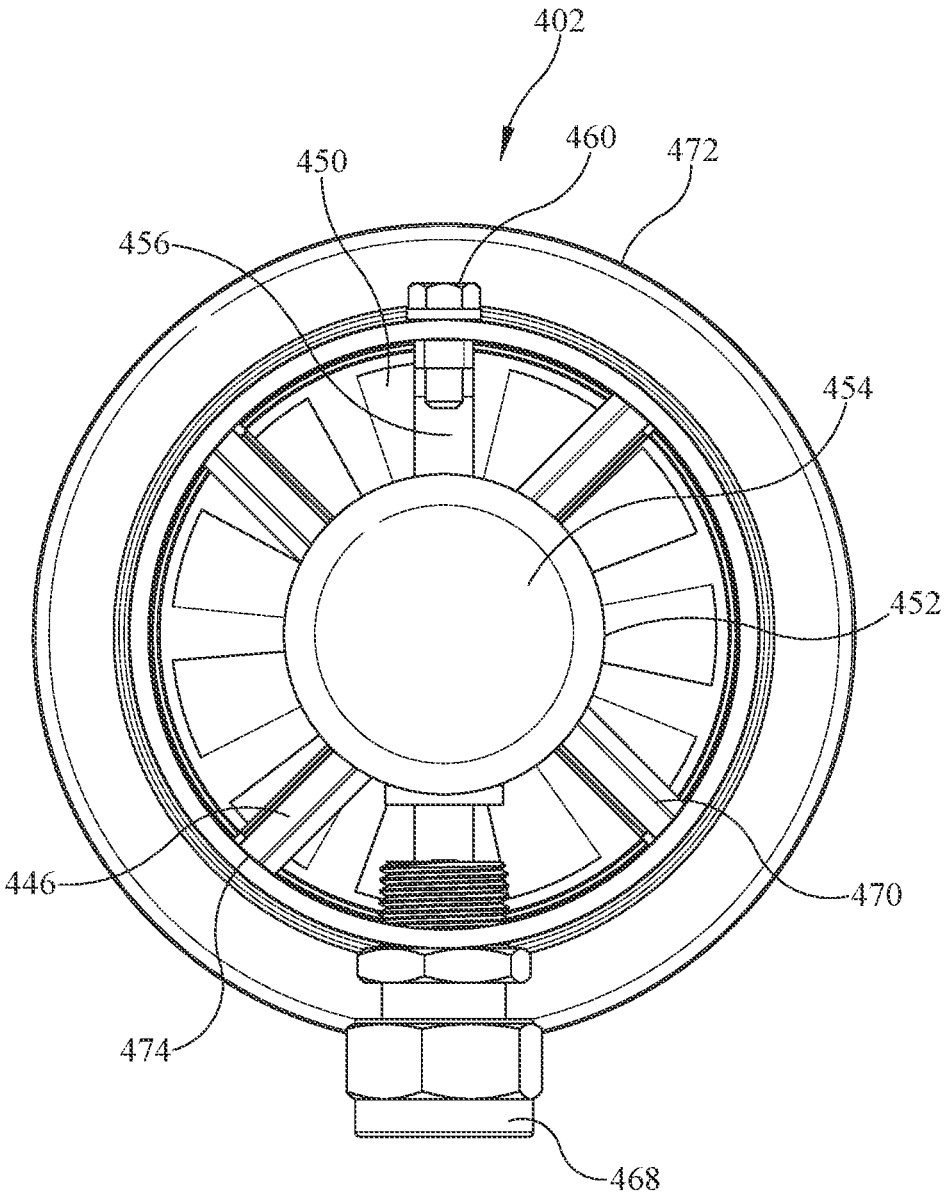
FIG. 15 is a front elevational view of the blower of FIG. 13.
Figure 16:
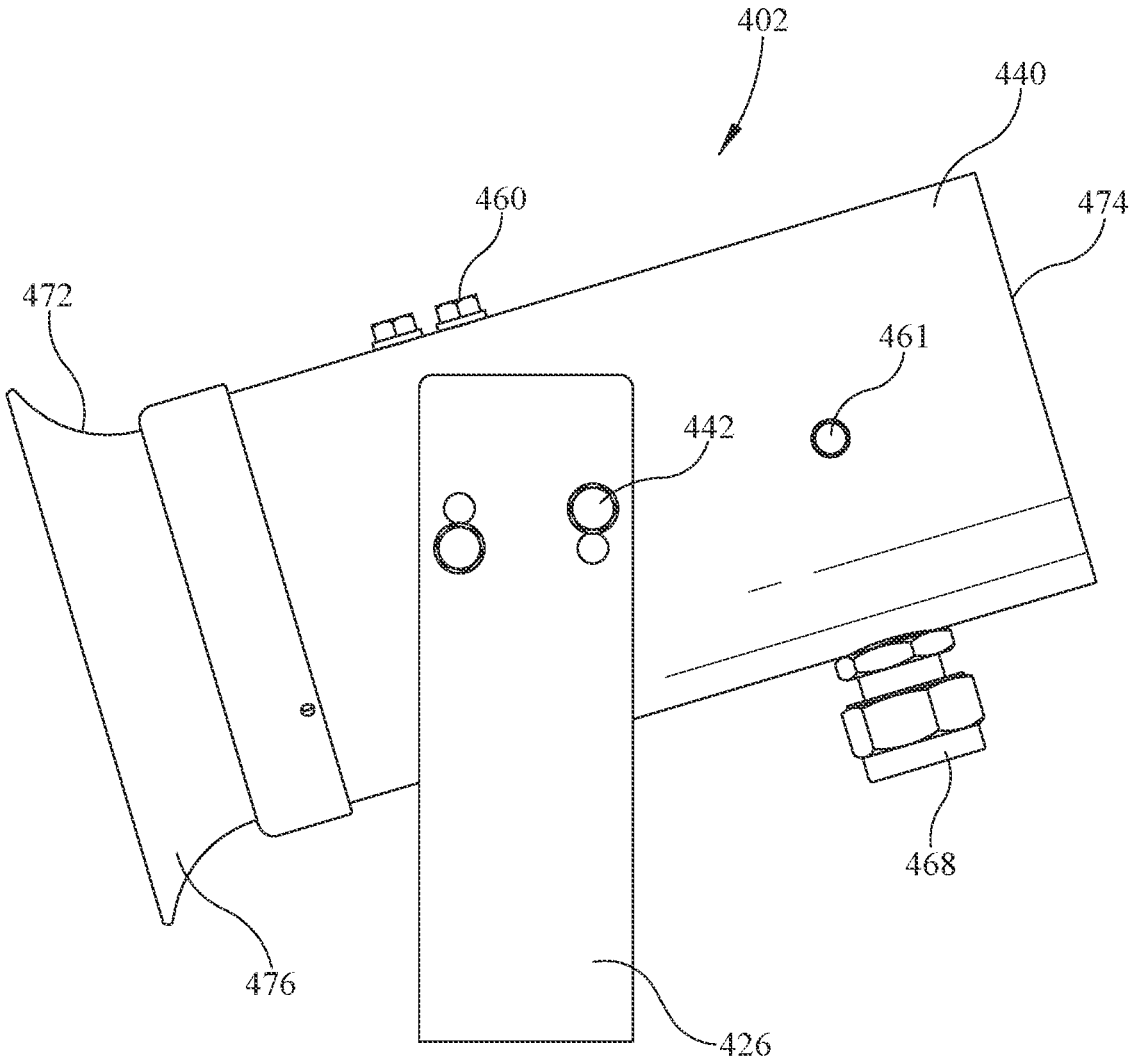
FIG. 16 is a side elevational view of the blower and mounting bracket of FIG. 13.
Figure 17:
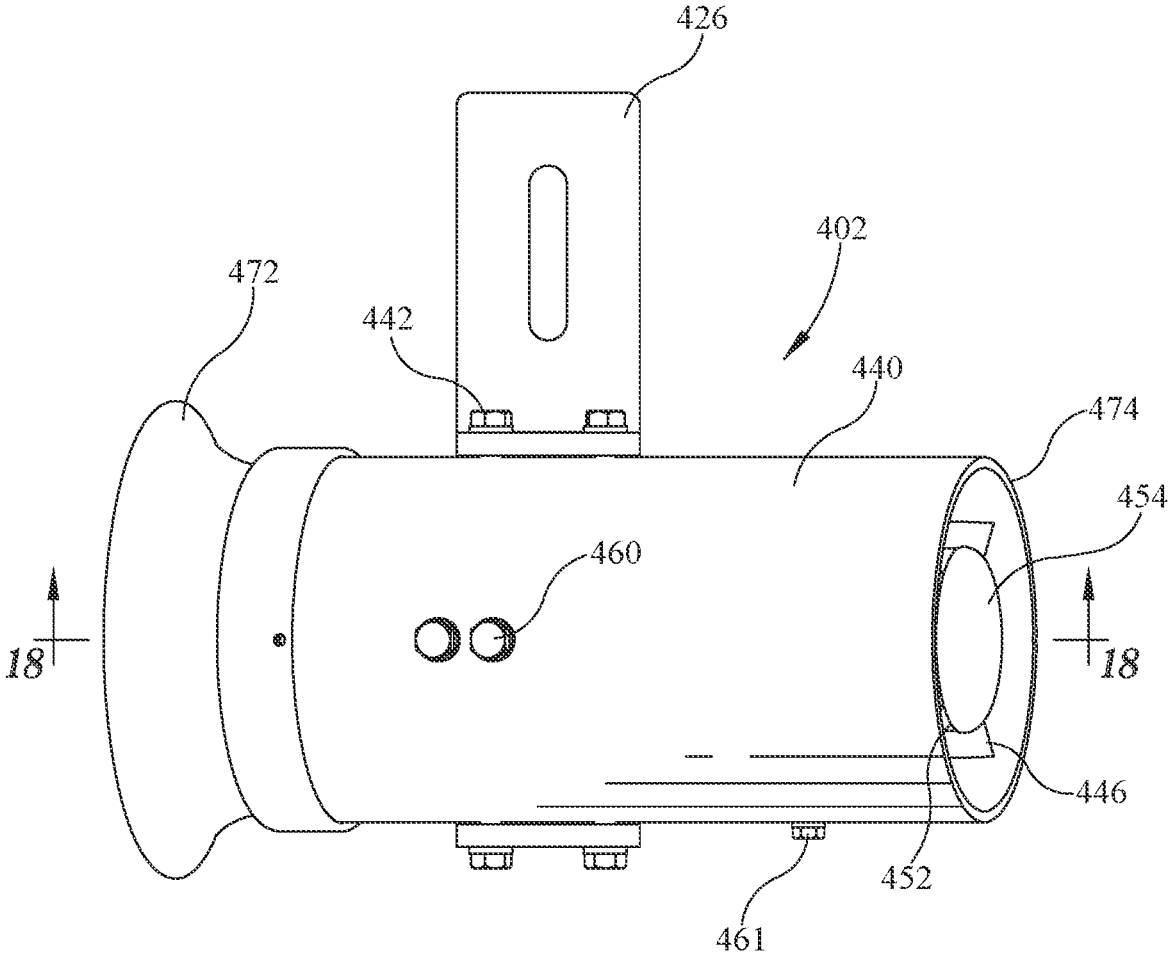
FIG. 17 is a top plan view of the blower and mounting bracket of FIG. 13.
Figure 18:
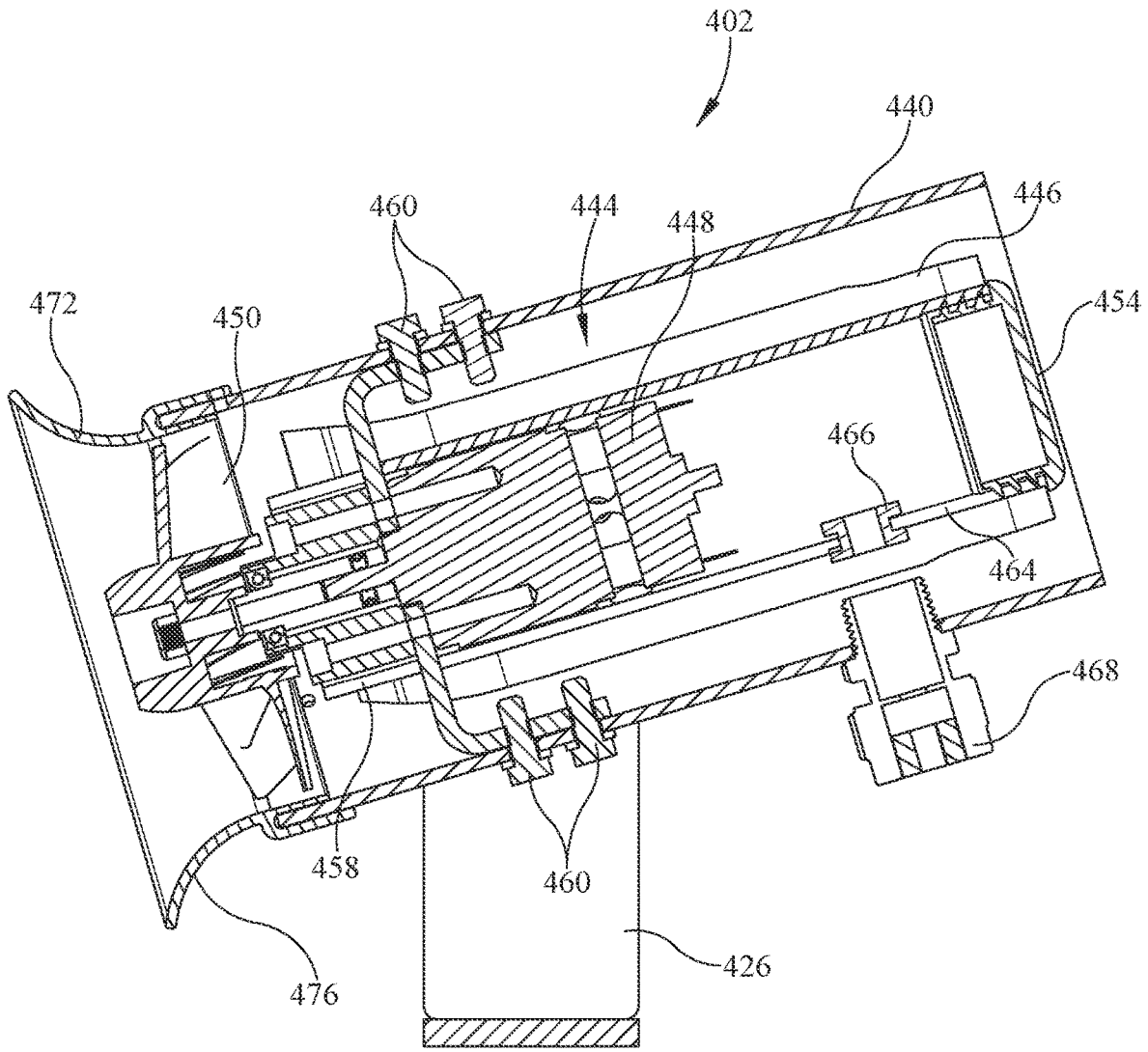
FIG. 18 is a cross-sectional view of the blower and mounting bracket of FIG. 17, taken through lines 18-18 thereof.

Now turning to FIGS. 10-18, these figures illustrate a portion of a load wrapping apparatus 400 including an example implementation of a flow stabilized high speed axial fan blower 402 consistent with some embodiments of the invention. As illustrated in FIG. 10, load wrapping apparatus 400 is a rotating arm-type load wrapping apparatus, e.g., an S-300XT Semi-Automatic Stretch Wrapper available from Lantech.com, LLC (the assignee of the present application) and includes a base 404 that supports a mast 406 using a pair of legs 408 that generally straddle a load 410. While not shown in FIG. 10, mast 406 supports a rotating arm that is used to rotate the packaging material dispenser about the load. In this embodiment, load 410 is supported on a floor 412, and a support assembly 414, also referred to as a cut and clamp assembly, is positioned adjacent load 410 and is configured to both position a leading end of a packaging material web against load 410 at the start of a wrapping operation and sever a trailing end of the packaging material web wrapped around load 410 at the end of a wrapping operation, similar to support assembly 120 discussed above.

Blower 402 is positioned within a bollard 416 of one of legs 408, and is generally directed towards a corner C of load 410. With additional reference to FIGS. 11-12, bollard 416 includes a base plate 418, a top plate 420 and a side wall 422 joined to one another through a plurality of fasteners 424, and blower 402 is supported by a mounting bracket 426 that orients the blower to direct a flow a fluid out of an opening 428 in side wall 422. Vents 430 in side wall 422 allow for ambient air to be drawn into blower 402.

Returning to FIG. 10, load wrapping apparatus 400 in the illustrated embodiment is a semi-automatic rotating arm-type load wrapping apparatus that is suitable for wrapping loads that are positioned on floor 412 by fork trucks, e.g., in a distribution center, and in some embodiments, more than one load wrapping apparatus 400 may be used, and may share structural support. Bollard 432, for example, is configured to support two adjacent legs of two different load wrapping apparatuses, so in some embodiments, a second blower 434 may be disposed in bollard 432 to direct a flow of fluid at a different load being wrapped by a different load wrapping apparatus (not shown in FIG. 10).

It will be appreciated, however, that blower 402 may be used in a wide variety of different load wrapping apparatus types, including turntable-type or ring-type load wrapping apparatuses, as well as load wrapping apparatuses having different levels of automation (e.g., manual, automatic, or semi-automatic), for loads conveyed via fork trucks, hand trucks, or conveyors, or for loads supported on floors, turntables, conveyors, platforms, etc. Therefore, the invention is not limited to the use of blower 402 in a semi-automatic rotating arm-type load wrapping apparatus.

Blower 402 includes a generally cylindrical outer housing 440 having a longitudinal axis L and secured to mounting bracket 426 through a plurality of fasteners 442, e.g., threaded bolts. In some embodiments, cylindrical outer housing 440 may have a length of about 8 inches and a diameter of about 4 inches, and in some embodiments, it may be desirable to provide a length to diameter ratio of outer housing 440 that is between about 1.5 to 1 and about 4 to 1, with lower ratios suitable for blowers positioned closer to a load (e.g., 18-24 inches), and with higher ratios suitable for blowers positioned farther from a load (e.g., 45+ inches). Blower 402 includes an axial fan 444 that is upstream of a plurality of downstream stabilizing vanes 446. In the illustrated embodiment, axial fan 444 includes a motor 448 and an axial fan blade 450, while stabilizing vanes 446 extend axially within outer housing 440, supported by a cylindrical inner housing 452.

Inner housing 452 includes a threaded cap 454 at one end, and at the other end, the inner housing is open to receive motor 448. A mounting bracket 456 is secured to motor 448 and inner housing 452 includes a pair of slots 458 that receive arms of the mounting bracket 456, and a set of threaded fasteners 460 secure mounting bracket 456, and thus motor 448, within outer housing 440. A threaded fastener 461 secures inner housing 452 to outer housing 440. A plurality of apertures 462 are disposed in inner housing 452 to provide airflow to motor 448, and a slot 464 is used to support a grommet 466 that receives power wires (not shown) for motor 446 that are routed out of blower 402 through a fitting 468 secured to outer housing 440.

Motor 448 is a high speed motor, e.g., a GS-775M motor available from Genmitsu and axial fan blade 450 is a 539306001 fan blade available from Homelite, although motors and fans may be used in other embodiments. In some embodiments, for example, it may be desirable to utilize a motor having a speed rating of about 10,000 to about 40,000 RPM (or higher) and a low pitch axial fan blade having 8 to 15 blades, e.g., 11 blades, such that the axial fan 444 is capable of generating an air velocity of about 15 to about 50 MPH (or higher) at the output of blower 402, and in some embodiments, about 10 to about 25 MPH at the corner of the load. It will also be appreciated that motor 448 may be a variable speed DC motor in some embodiments and may have a speed that varies with voltage, thereby enabling the air velocity output by blower 402 to be regulated through control over the DC voltage supplied to the blower (e.g., between about 12 VDC and about 24 VDC). In some embodiments, motor 448 may be operated at at least about 10,000 RPM, while in some embodiments, motor 448 may be operated at at least about 20,000 RPM, and in some embodiments, motor 448 may be operated at at least about 40,000 RPM.

Also, in the illustrated embodiment a plurality of stabilizing vanes 446 disposed downstream of axial fan blade 450 to stabilize the flow of air output from blower 402, reducing turbulence and increasing air velocity at the load, as will be discussed in greater detail below. Four stabilizing vanes 446 are used in block 402, although it will be appreciated that different numbers of vanes may be used in other embodiments. In addition, stabilizing vanes 446 extend at least about 7 inches axially in some embodiments, although longer or shorter vanes may be used in other embodiments as well. In addition, as illustrated at 470, it may be desirable in some embodiments to utilize a curved leading edge on each stabilizing vane 446, with the curve extending in the opposite direction from the direction of rotation of motor 448 and axial fan blade 450 (here, counter-clockwise when viewed from an inlet 472 of blower 402), although the invention is not so limited. Opposite from inlet 472 is an outlet 474 from which air flow is directed from blower 402, and it may be seen that in the illustrated embodiment, each vane 446 has a trailing edge that extends proximate outlet 474, such that each vane 446 extends substantially throughout the space between axial fan blade 450 and outlet 474.

Moreover, in some embodiments, it may be desirable to flare inlet 472, such that inlet 472 serves as a collector to facilitate the intake of air into blower 402, e.g., by including an integrally-formed or attached flared portion of outer housing 440. In one embodiment, for example, a flared fitting 476 may be secured to outer housing 440 to provide a flared inlet for blower 402. In other embodiments, however, no flare or collector may be used. Furthermore, axial fan blade 450 is desirably positioned with a leading end thereof substantially even with where inlet 472 begins to flare, i.e., at a narrower diameter end of the flare. Furthermore, where a separate flared fitting is used, axial fan blade 450 may be positioned with the leading end thereof substantially even with the inlet end of outer housing 440.

Figure 19:
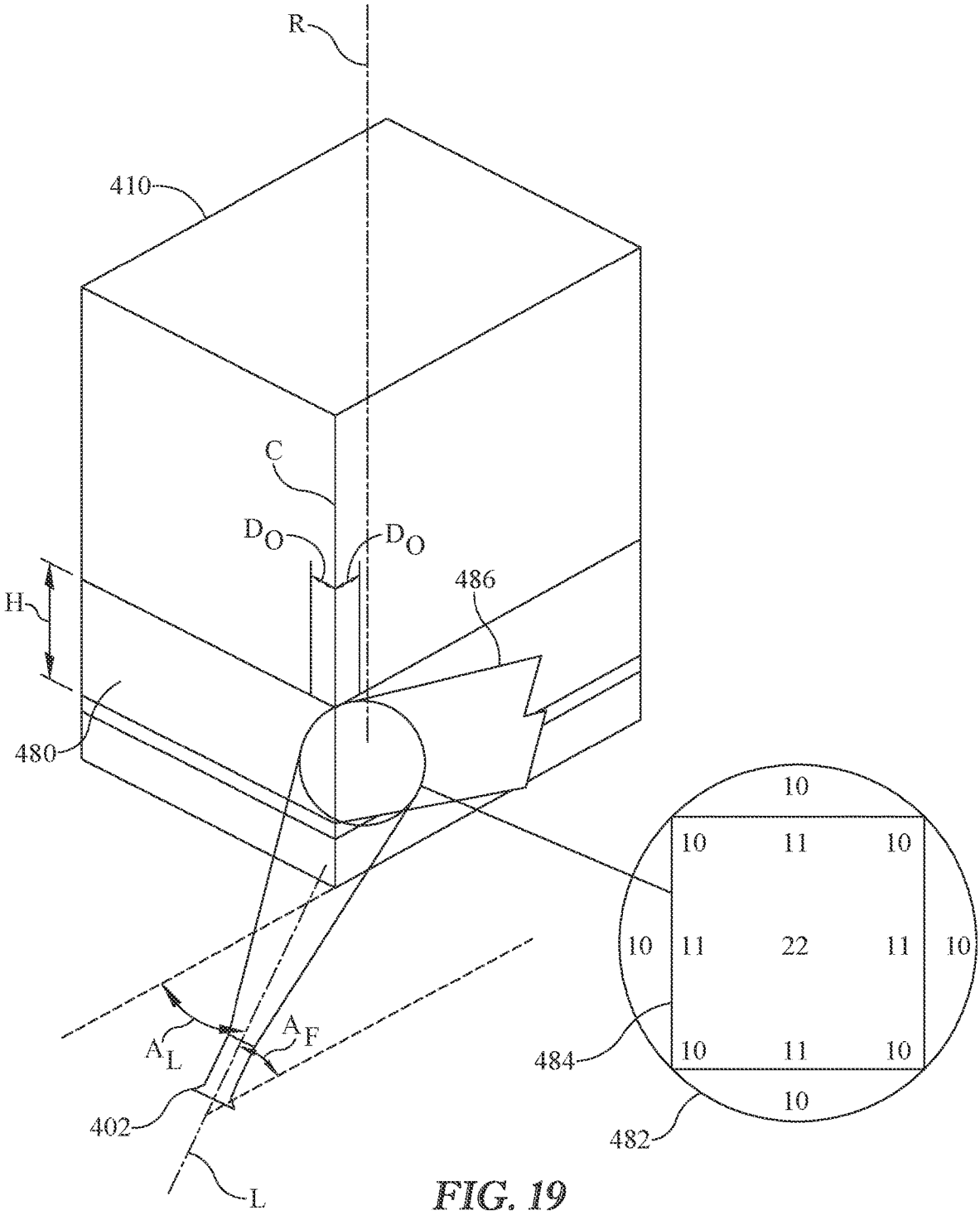
FIG. 19 is a functional perspective view of the load wrapping apparatus of FIG. 10.

Each of the aforementioned design features has been found to contribute to a blower design capable of generating fluid flow having a velocity, distribution, and turbulence that is suitable for adhering a packaging material tail to a side of a load in an effective and visually-desirable manner. With additional reference to FIG. 19, for example, assuming a 40×48 inch load 410 and a packaging material web 480 from a 20 inch supply roll, which when wrapped around load 410 under tension, has a web height H of about 17 inches, a circular target area 482, which may be considered to be a cross-sectional area proximate the corner C of the load, and in a plane generally transverse to the longitudinal axis L of blower 402, may be defined with a diameter of about 17 inches, or alternatively a 12 inch square target area 484 may be defined for adhering a tail 486 to the side of load 410. It may be desirable to position blower 402 with its output about 45 inches from the corner of a load 410, and with an orientation providing a direction of flow relative to the side of load 410 (angle $A_L$) of about 25 degrees and an angle of incline from the floor (angle $A_F$) of about 16.5 degrees. It may also be desirable to direct the flow to have a minimum offset distance Do on each side of corner C, e.g., at least about 3 inches, over the range of expected positions of load 410, given that load 410 may be positioned by a fork truck with varying offsets from the center of rotation R for load wrapping apparatus 400, so it cannot be assumed that a load will be positioned in the exact same location for every load wrapping operation.

With an about 50 MPH fluid flow at the outlet 474 of blower 402, it may be seen that the air velocity at the center of each target area 482, 484 is about 22 MPH, while the air velocity around the perimeter of each target area 482, 484 is about 10 MPH, thereby providing a well-distributed air velocity across the width of each target area, and thus the packaging material web 480 and tail 486.

Such a configuration may have a number of advantages of alternate flow device designs. For example, as compared to a flow device that relies on pressurized fluid supplied by a compressor, blower 402 can be used for an extended amount of time if desired. Moreover blower 402 may be used in applications where pressurized fluid is problematic, e.g., in cold conditions (e.g., below about 36 degrees Fahrenheit) where air dryers are often required, or in applications where pressurized fluid is not available. In addition, even where pressurized air is used for other operations in a load wrapping apparatus, the requirements are substantially reduced.

Blower 402 is also cost effective and easily retrofittable into existing load wrapping apparatuses. In addition, as with other designs discussed above, blower 402 may be combined with a heater to heat the air exiting the blower to warm up the packaging material tail and improve tackiness.

For other load wrapping apparatuses, different positioning and performance characteristics may be desired. For example, for an SL Automatic Rotating Arm-Type Stretch Wrapper available from Lantech.com, LLC (the assignee of the present application), blower 402 may be mounted to a support leg of the machine, outside of the zone of rotation and about 42 to about 45 inches from the corner of the load at about the same elevation as the turntable, with a direction of flow relative to the side of a load (angle $A_L$) of about 40 to about 60 degrees and an angle of incline from the floor (angle $A_F$) of about 8 degrees. A similar target area profile as discussed above in connection with FIG. 19 may be provided using an about 50 MPH air velocity at the output of the blower.

As another example, for a QL Automatic Turntable-Type Stretch Wrapper available from Lantech.com, LLC (the assignee of the present application), blower 402 may be mounted to a support leg of the machine, outside of the zone of rotation and about 31 inches from the corner of the load at about the same elevation as the turntable, with a direction of flow relative to the side of a load (angle $A_L$) of about 40 degrees and an angle of incline from the floor (angle $A_F$) of about 16.5 degrees. Due to the closer distance to the load, a target area profile having a central air velocity of about 30 MPH and a perimeter air velocity of about 12 MPH may be provided using an about 50 MPH air velocity at the output of the blower.

As yet another example, for a G Semi-Automatic Turntable-Type Stretch Wrapper available from Lantech.com, LLC (the assignee of the present application), blower 402 may be mounted to a support leg of the machine, outside of the zone of rotation and about 13 inches from the corner of the load at about the same elevation as the turntable, with a direction of flow relative to the side of a load (angle $A_L$) of about 60 degrees and an angle of incline from the floor (angle $A_F$) of about 16.5 degrees. Due to the closer distance to the load, a smaller target area profile may be defined, e.g., as a circular target area having an about 11 inch diameter or an 8" square target, and that smaller target area profile may have a central air velocity of about 36 MPH and a perimeter air velocity of about 22 MPH based upon an about 50 MPH air velocity at the output of the blower.

Blower 402, in different embodiments, may be used to provide a flow of fluid from a position generally upstream of a free end of the packaging material tail and at an acute angle relative to the side of the load while the free end of the packaging material tail is unsupported to cause the packaging material tail to come into contact with the side of the load. In addition, in some embodiments, a blower similar to blower 402 may be used as a second flow device for directing a second flow of fluid towards the packaging material tail from a second position and at different angle from that of blower 402 to increase adherence of the packaging material tail to the side of the load. In other embodiments, however, other flow devices discussed above may be used at the second flow device, while in still other embodiments, no second flow device may be used, with only a single flow of fluid from blower 402 used to adhere a packaging material tail to the load, or alternatively, where the load is rotatable relative to the blower, e.g., as in the case with a turntable-type wrapping apparatus, the same blower 402 may be used to direct the second flow of fluid towards the packaging material tail after the load has been further rotated after directing the first flow of fluid towards the packaging material tail. It will also be appreciated that blower 402 may be used as the first flow device and/or the second flow device in the various embodiments discussed above in connection with FIGS. 1-9.

Figure 20:
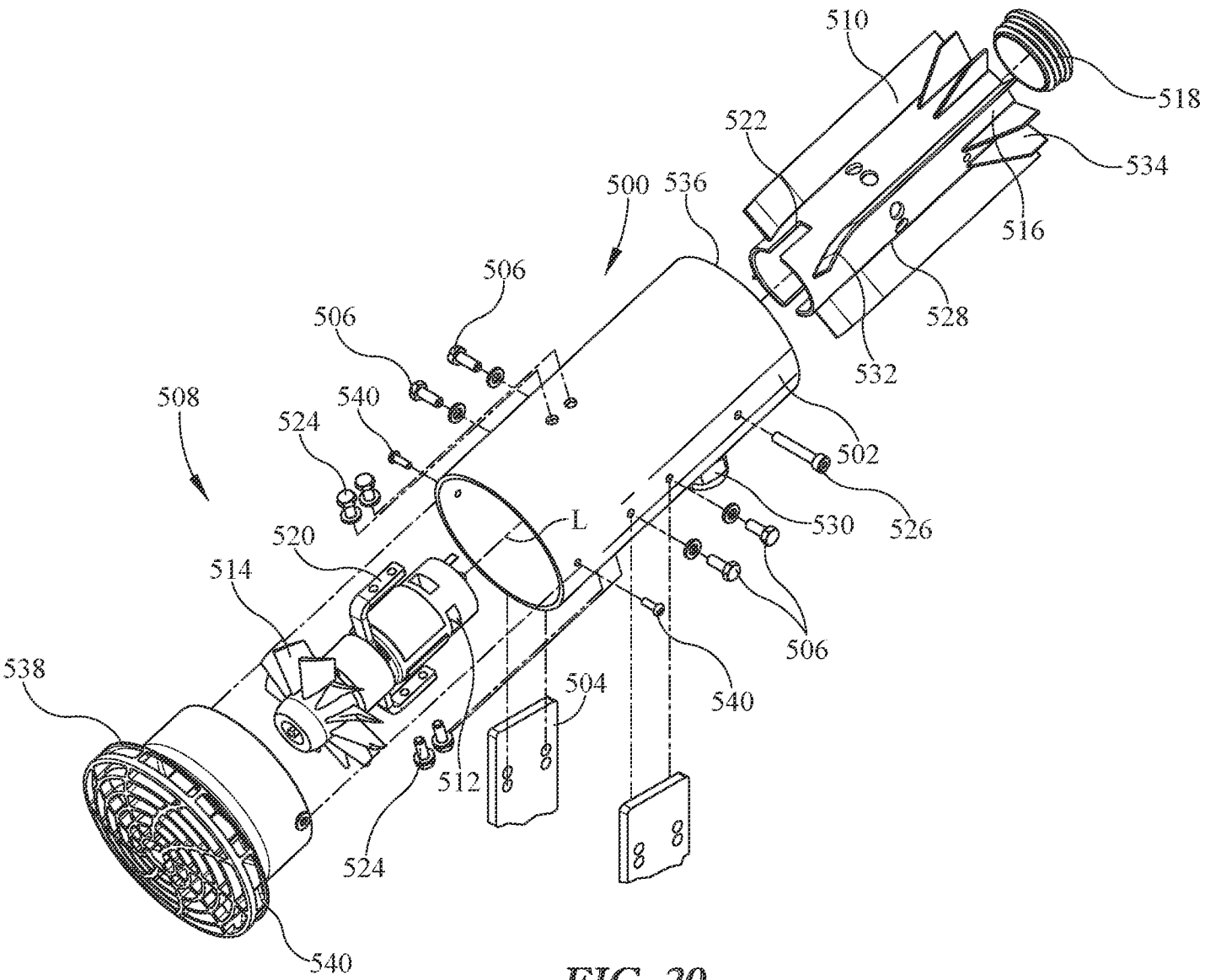
FIG. 20 is an exploded perspective view of another example flow stabilized high speed axial fan blower consistent with some embodiments of the invention.

FIG. 20 illustrates another flow stabilized high speed axial fan blower 500 consistent with some embodiments of the invention. Blower 500 is similar in many respects to blower 402 of FIGS. 10-19, and includes a generally cylindrical outer housing 502 secured to a mounting bracket 504 through a plurality of fasteners 506, e.g., threaded bolts, as well as an axial fan 508 that is upstream of a plurality of downstream stabilizing vanes 510. In the illustrated embodiment, axial fan 508 includes a motor 512 and an axial fan blade 514, while stabilizing vanes 510 extend axially within outer housing 502, supported by a cylindrical inner housing 516.

Inner housing 516 includes a threaded cap 518 at one end, and at the other end, the inner housing is open to receive motor 512. A mounting bracket 520 is secured to motor 512 and inner housing 516 includes a pair of slots 522 that receive arms of the mounting bracket 520, and a set of threaded fasteners 524 secure mounting bracket 520, and thus motor 512, within outer housing 502. A threaded fastener 526 secures inner housing 516 to outer housing 502. A plurality of apertures 528 are disposed in inner housing 516 to provide airflow to motor 512, and a fitting 530 is secured to outer housing 502 to pass power wires to motor 512.

In this embodiment, stabilizing vanes 510 may also include curved leading edges 532, and inner housing 516 may also include, in addition to stabilizing vanes 510, a plurality of (e.g., eight) shorter vanes 534 distributed around the perimeter of inner housing 516 to restrict access to the interior of outer housing 502 through outlet 536. Moreover, in this embodiment, a flared inlet is provided on blower 500 using a flared fitting 538 that is secured to outer housing 502 by a pair of threaded fasteners 540. In addition, a cover or grill 542 is provided on flared fitting 538 to restrict external access to the interior of outer housing 502, including axial fan 508.

Downstream Packaging Material Tail Adherence Operation

It may also be desirable in some embodiments to perform a packaging material tail adherence operation downstream of a wrapping operation and the wrap position at which the load is disposed when such a wrapping operation is performed, in order to increase adherence of a packaging material tail to a load. In some applications, for example, such as in colder, drafty or windy environments, a packaging material tail, adhered to a load in the various manners described above, may benefit from an additional packaging material tail adherence operation to increase adherence of the tail to the load, and thereby reduce the likelihood of the tail delaminating from the load during shipping or transport.

In some embodiments consistent with the invention, for example, a packaging material tail adherence operation may be performed after a wrapping operation has been completed, and the packaging material tail has been formed and initially positioned over the load, e.g., using the aforementioned first stage, and in some instances, the second stage, discussed above. In some embodiments, a packaging material tail adherence operation may also be performed after a mechanical wiping operation, e.g., using a mechanical wiping assembly, has been performed.

A packaging material tail adherence operation may also be performed after the load has been moved away from the wrap position at which the load is disposed when the wrapping operation is performed, e.g., using a conveyor. By doing so, a flow device may be positioned adjacent to the conveyor, and in relatively close proximity to the load, to facilitate a desirable fluid flow pattern suitable for increasing the adherence of the packaging material tail to the load.

In the illustrated embodiments, a packaging material tail adherence operation is performed using a flow device that is configured to direct a flow of fluid towards the packaging material tail at an angle relative to the side of the load that in some instances is substantially orthogonal to the side of the load, and in other instances an acute angle of greater than about 45 degrees relative to the side of the load. It is generally desirable for the flow of fluid to engage the packaging material tail throughout a target area that is substantially upstream of an end of the packaging material tail, and that, in some instances, establishes lateral fluid flow along the side of the load towards the end of the packaging material tail to deter separation of the end of the packaging material tail from the load.

In addition, while a tail adherence operation may be performed using a similar flow device, and from a similar position relative to the load, as the second stage operation discussed above, in many embodiments it is desirable to generate fluid flow during a tail adherence operation to engage the tail across a relatively large portion of the width of the tail, and generally over a longer duration, to effectively "press" the tail against the side of the load to increase adherence. In some embodiments, for example, a second stage operation may be implemented using pressurized nozzles, and impact the tail with brief blasts of high velocity air in a few specific locations to ensure that the tail, once blown onto the side of the load by the first stage, adheres to the load. Where a tail adherence operation follows such a stage, a longer duration, and more broadly distributed fluid flow across much of the width of the tail may be used to increase adherence beyond that supplied by the second stage. In some embodiments, for example, a flow stabilized high speed axial fan blower as described above may be well suited for providing the desired fluid flow for a tail adherence operation.

Figure 21:
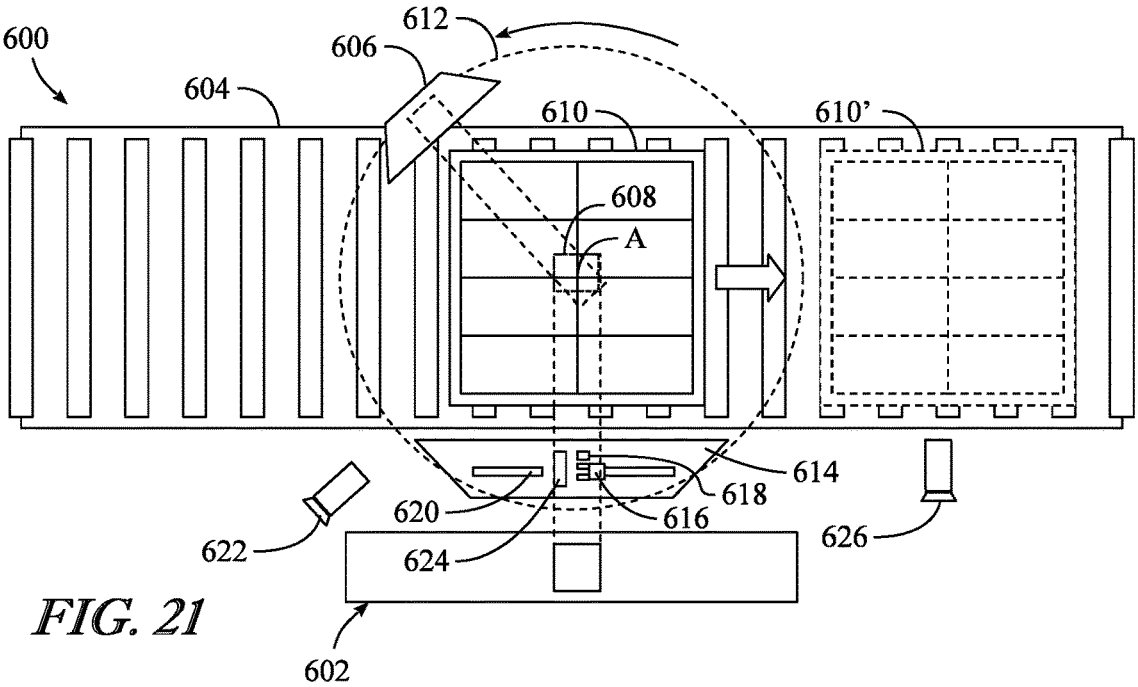
FIG. 21 is a top plan view of a rotating arm-type wrapping apparatus consistent with the invention.

Now turning to FIG. 21, this figure illustrates an apparatus 600 including a rotating arm-type load wrapping apparatus 602 positioned adjacent a conveyor 604 and including a packaging material dispenser 606 supported on a rotating arm driven by a rotational drive 608 for relative rotation about an axis of rotation A to wrap packaging material from a packaging material web dispensed from the packaging material dispenser about a load 610. Load wrapping apparatus 602 defines a wrap zone 612 based at least in part on the zone of rotation of packaging material dispenser 606. In addition, load 610 may be considered to be disposed at a wrap position as illustrated in FIG. 21, i.e., the position at which the load is disposed when the wrapping operation is performed. It will be appreciated that with a rotating arm-type load wrapping apparatus, load 610 remains stationary during the wrapping operation. For other types of load wrapping apparatuses, however, relative rotation may be generated via rotation of the load (e.g., on a turntable, where a rotational drive is used to rotate the turntable, rather than the packaging material dispenser). Nonetheless, it will be appreciated that even when the load itself is rotated, the load may still be considered for the purposes of this disclosure to be disposed in a single wrap position, within the wrap zone, during the wrap operation.

Similar, for example, to apparatus 100 of FIGS. 1-7, apparatus 600 may include a support assembly 614, also referred to as a cut and clamp assembly, that supports a packaging material holder 616 for selectively holding and releasing (or engaging and disengaging) a leading end portion of a packaging material web, a cutting assembly 618 for severing the packaging material web, and an insertion tool 620 for urging the web of packaging material into an opening 130 disposed between opposing jaws of packaging material holder 616.

In addition, similar to apparatus 100, apparatus 600 may also include first and second flow devices 622, 624 suitable for performing the aforementioned first and second stages for initially adhering the packaging material tail to the load. In addition, in some embodiments, first flow device 622 may be configured as a flow stabilized high speed axial fan blower, e.g., similar to flow stabilized high speed axial fan blower 402 described above in connection with FIGS. 10-18 or flow stabilized high speed axial fan blower 500 described above in connection with FIG. 20.

Apparatus 600 also includes a third flow device 626 that is disposed downstream of load wrapping apparatus 602, e.g., downstream of wrap zone 612, and configured to direct a flow of fluid towards a packaging material tail adhered to load 610 from a position adjacent to a side of the load and at an angle relative to the side of the load after the load has been moved away from its initial wrap position to increase adherence of the packaging material tail to the side of the load. In some embodiments, for example, flow device 626 may be positioned adjacent to conveyor 604 such that when load 610 is conveyed to the position illustrated at 610', the flow device may be actuated to perform a tail adherence operation consistent with the invention.

It will be appreciated that a tail adherence operation is generally performed after the load has been moved away from the wrap position illustrated for load 610 in FIG. 21. In some embodiments, the movement away may constitute movement of the load fully outside of the wrap zone 612; however, in other embodiments, such movement away may constitute only movement away from the initial wrap position, and as such, a tail adherence operation in some embodiments may be performed while the load is still fully or partially within the wrap zone.

Further, in other embodiments, a tail adherence operation may be performed while the load is still in the initial wrap position, i.e., has not moved since it was wrapped. In addition, in some embodiments, a tail adherence operation may be performed from a different location while the load remains in the wrap position, e.g., based upon rotation of the load (e.g., on a turntable) to orient the packaging material tail in a different rotational orientation opposing a suitable flow device (e.g., as discussed in greater detail below in connection with FIG. 25). In some embodiments, for example, the load may be rotated about a center of rotation of a turntable after the tail has been initially adhered to the side of the load to perform the tail adherence operation.

Figure 22:
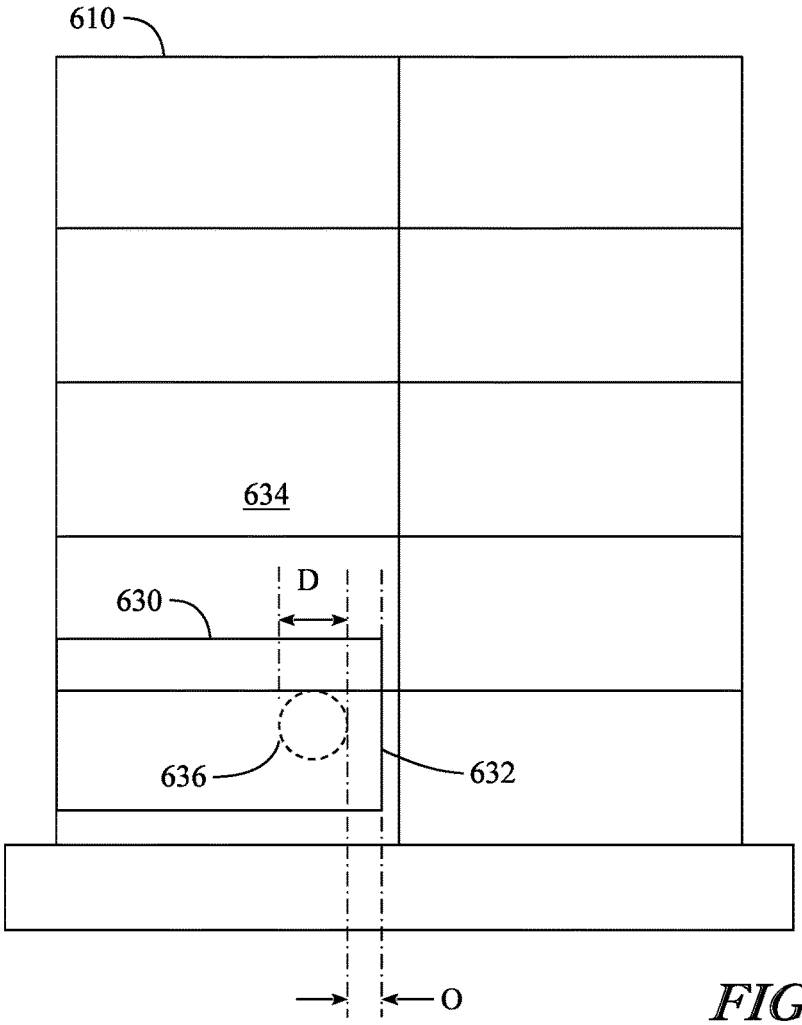
FIG. 22 is a side elevational view of a load, illustrating a target area for a tail adherence operation performed using the apparatus of FIG. 21.
Figure 23:
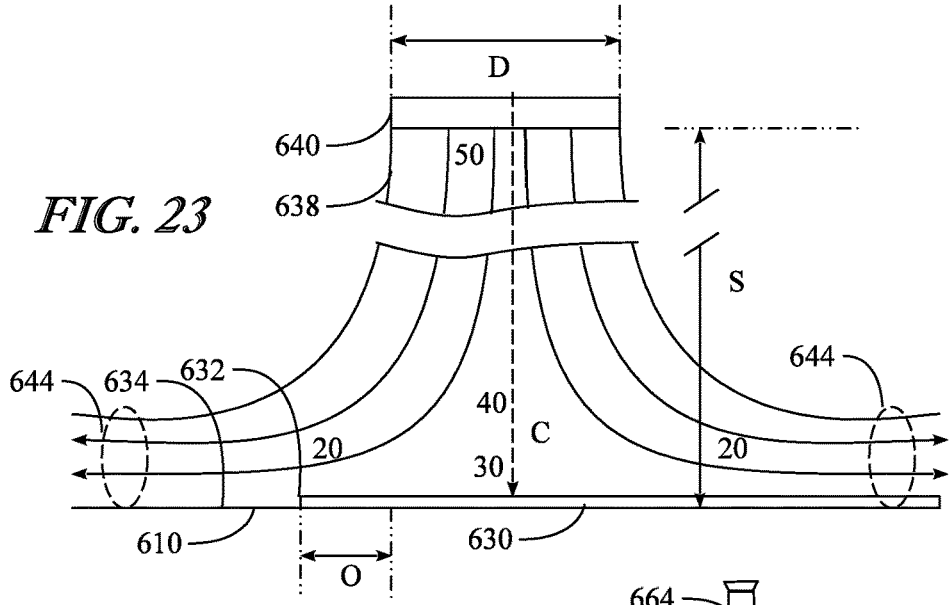
FIG. 23 is a functional view of the load of FIG. 22, illustrating fluid flow proximate the side of the load.

Now turning to FIGS. 22 and 23, a packaging material tail 630, including an end 632 formed by cutting the packaging material web, is illustrated on a side 634 of load 610. FIG. 22, for example, may illustrate packaging material tail 630 after the tail has been formed and blown onto the side of the load using flow devices 622, 624, and after the load has been conveyed to the position illustrated at 610' in FIG. 21. In the illustrated embodiment, it is generally desirable to generate a flow of fluid that engages packaging material tail 630 throughout a target area 636 that is substantially upstream of end 632 of packaging material tail 630.

Figure 24:
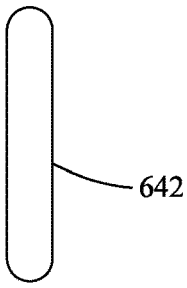
FIG. 24 is a functional view of a flat profile outlet capable of being used with the apparatus of FIG. 21.

The target area, in this regard, may be considered to represent the area where the primary fluid flow "column" generated by flow device 626 (illustrated at 638 in FIG. 23) is projected or directed towards side 634 of load 610. Assuming, for example, that a flow device with a circular outlet is used (e.g., an outlet 640 of flow device 626, as illustrated in FIG. 32), the column may have a substantially cylindrical profile, although other profiles may also be used. FIG. 24, for example, illustrates one example alternate profile, a vertically-oriented flat profile 642, although other profiles may be used in other embodiments, as will be appreciated by those of ordinary skill having the benefit of the instant disclosure.

Returning to FIGS. 22-23, it will be appreciated that from a fluid dynamics perspective, the edges of fluid flow column 638 will be dynamic in nature and will decrease in velocity the further from the central axis of the fluid flow column, so for the purposes of this disclosure, the boundary of a fluid flow column may be considered to be located in a position where the velocity of the fluid flow falls below a predetermined percentage (e.g., about 50 percent) of the velocity of the fluid flow along the central axis of the fluid flow column, such that the outer boundary of the target area 636 may be considered to be defined by the projection of the fluid flow column 638 along its central axis and onto the side of the load. As shown in FIGS. 22 and 23, for example, for a circular target area 636, the target area may be considered to have a diameter D based upon the fluid flow column projected onto the side of the load.

In addition, as noted above, it is generally desirable for the target area 636 to be disposed upstream of the end 632 of packaging material tail 630, e.g., by an offset O (illustrated in FIG. 22). In particular, it may be generally desirable in some embodiments to orient the target area such that the closest point of the target area is offset from the end of the packaging material tail by a predetermined distance, e.g., at least about 1 inch in some embodiments, and at least about 2 inches in some embodiments. By doing so, and as illustrated by regions 644 of FIG. 23, lateral fluid flow generated from the engagement of the fluid column with the side of the load will be directed towards the end of the packaging material tail, which deters separation of the end of the packaging material tail from the load. In instances where a portion of the target area overlaps the end of the packaging material tail, for example, a risk exists that turbulent fluid flow in the region of the target area may direct fluid flow under the end of the packaging material tail to urge it away from the side of the load, and potentially cause delamination of the packaging material tail from the load.

While other fluid flow devices may be used in other embodiments, flow device 626 is implemented using a flow stabilized high speed axial fan blower as described above in connection with FIGS. 10-18 and 20, which provides a relatively focused fluid flow column with relatively high velocity and flow volume, and capable of exerting a relatively high force that presses the packaging material tail against the side of the load. In some embodiments, for example, and with reference to FIG. 23, flow device 626 may generate a fluid flow column with a diameter D of about 4 inches and an exit velocity proximate the central axis C of at least about 50 mph from a separation S of about 18 inches, and in some instances, less than about 6-12 inches, from the side of the load. In such an embodiment, the velocity has been found to generally decrease to about 40 mph at about 2 inches from the side of the load, and to about 30 mph at about 0.5 inches from the side of the load, and to generate lateral fluid flow of about 20 mph in all directions from about 18 inches from the central axis. It has been found that such a fluid column may generate at least about 630 grams of force throughout the target area to press the packaging material tail against the side of the load and thereby increase the adherence of the tail to the side of the load.

In general, in some embodiments, it may be desirable for flow device 626 to generate a fluid velocity that is at least about 20 mph throughout the target area to assist with adhering the packaging material tail to the load. In other embodiments, however, other flow devices, velocities and profiles may be used, so the invention is not limited to the specific embodiments disclosed herein.

Figure 25:
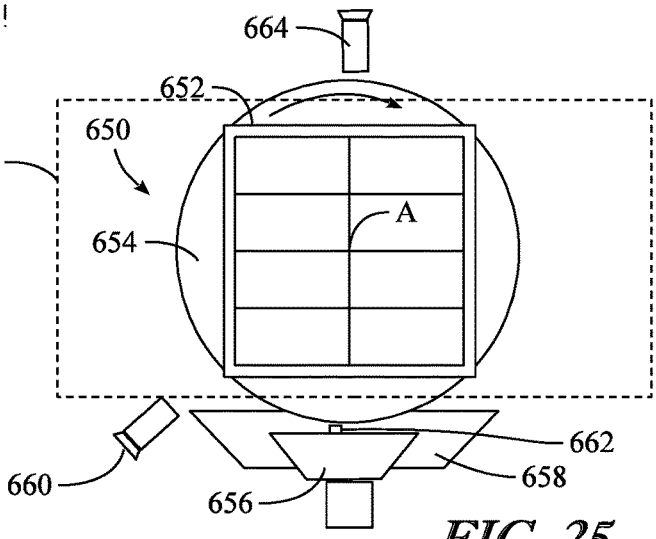
FIG. 25 is a top plan view of a turntable-type wrapping apparatus consistent with the invention.
Figure 26:
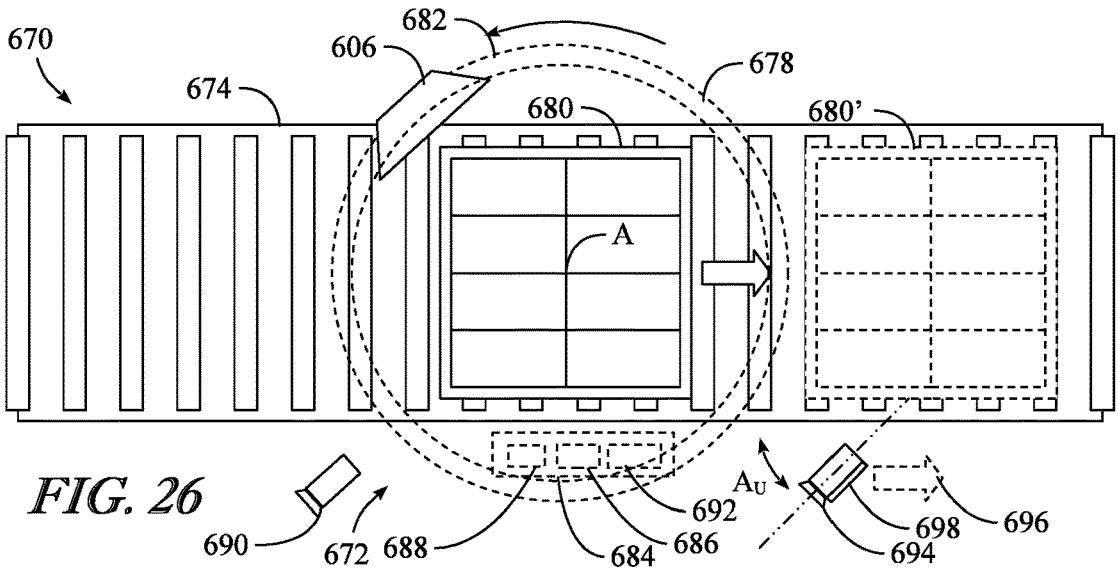
FIG. 26 is a top plan view of a ring-type wrapping apparatus consistent with the invention.

FIGS. 25 and 26 next illustrate various alternative configurations and functionality that may be used in other embodiments of the invention. FIG. 25, in particular, illustrates a turntable-type load wrapping apparatus 650 in which a load 652 is supported on a turntable 654 that is rotated by a rotational drive (not shown in FIG. 25) to generate relative rotation between load 652 and a packaging material dispenser 656. A cut and clamp assembly 658 may also be disposed adjacent to the turntable 654 to clamp the packaging material at the end of a wrapping operation, and sever the packaging material to form a packaging material tail that may be initially adhered to the side of load 652 using one or more flow devices, e.g., flow device 660 and flow device 662, which in some instances may be similar to flow devices 622 and 624 of FIG. 21.

In addition, in this embodiment, rather than moving the load away from a wrapping position in order to perform a tail adherence operation, as is the case in FIG. 21, load wrapping apparatus 650 includes a flow device 664 (configured, for example, similar to flow device 626 of FIG. 21) that is disposed at a predetermined rotational position about the axis of rotation A about which turntable 654 is rotated such that controlled rotation of the load about the axis of rotation A to an appropriate rotational position will orient flow device 664 relative to the packaging material tail to perform a tail adherence operation that engages the packaging material tail throughout a target area that is substantially upstream of the end of the packaging material tail. By positioning flow device 664 opposite packaging material dispenser 656, for example, flow device 664 may be positioned relatively close to the side of the load, while also remaining out of the way of the cut and clamp assembly and other components, e.g., a conveyor (a portion of which is illustrated at 666 in FIG. 25). As such, in some embodiments, it may be desirable to rotate the load to a predetermined rotational position after wrapping in order to perform a tail adherence operation.

FIG. 26 illustrates an apparatus including a rotating ring-type load wrapping apparatus 672 positioned adjacent a conveyor 674 and including a packaging material dispenser 676 supported on a rotating ring 678 rotated by a rotational drive (not shown) for relative rotation about an axis of rotation A to wrap packaging material from a packaging material web dispensed from the packaging material dispenser about a load 680. Load wrapping apparatus 672 defines a wrap zone 682 based at least in part on the zone of rotation of packaging material dispenser 676. In addition, load 680 may be considered to be disposed at a wrap position as illustrated in FIG. 26, and generally remains stationary during the wrapping operation. A cut and clamp assembly 684, which typically is supported overhead by a vertically-movable carriage (not shown in FIG. 26), supports a packaging material holder 686 for selectively holding and releasing (or engaging and disengaging) a leading end portion of a packaging material web and a cutting assembly 688 for severing the packaging material web.

In addition, similar to apparatus 600, apparatus 670 may also include a flow device 690. However, rather than including a second stage flow device, a mechanical wiping assembly 692 is instead utilized to mechanically wipe the packaging material tail against the side of the load.

Apparatus 670 also includes a flow device 694 suitable for performing a tail adherence operation consistent with the invention. While flow device 694 may also be configured as a flow stabilized high speed axial fan blower similar to that described above, other flow device designs may be used in other embodiments. In addition, rather than being positioned at a fixed position downstream of the wrap zone and oriented substantially orthogonal to the side of the load, as is the case with flow device 626 of FIG. 21, flow device 694 illustrates that it may be possible in some embodiments to orient the flow device at a different angle Au relative to the side of the load, e.g., an acute angle of greater than about 45 degrees relative to the side of the load originating from an upstream position relative to the end of the packaging material tail, as well as to move at least an outlet of the flow device with the load, as represented by arrow 696. Thus, as the load moves from the wrap position to the position illustrated at 680', flow device 694 may move parallel to the load and maintain a same relative orientation throughout at least a portion of the tail adherence operation. By doing so, pausing of the conveyor in order to perform the tail adherence operation may be avoided in some instances, such that continuous movement of the load may be maintained throughout at least a portion of the tail adherence operation.

Moreover, in some embodiments a heater 698 may be used to heat the flow of fluid generated by flow device 694 and thereby increase the adherence of the packaging material tail to the side of the load.

It will be appreciated that any of the variations discussed above in connection with FIGS. 25 and 26 may be utilized separately from one another, and may be utilized on other types of load wrapping apparatuses, e.g., various types of rotating arm-type, turntable-type or rotating ring-type load wrapping apparatuses. Therefore, the invention is not limited to the specific embodiments illustrated herein.

Figure 27:
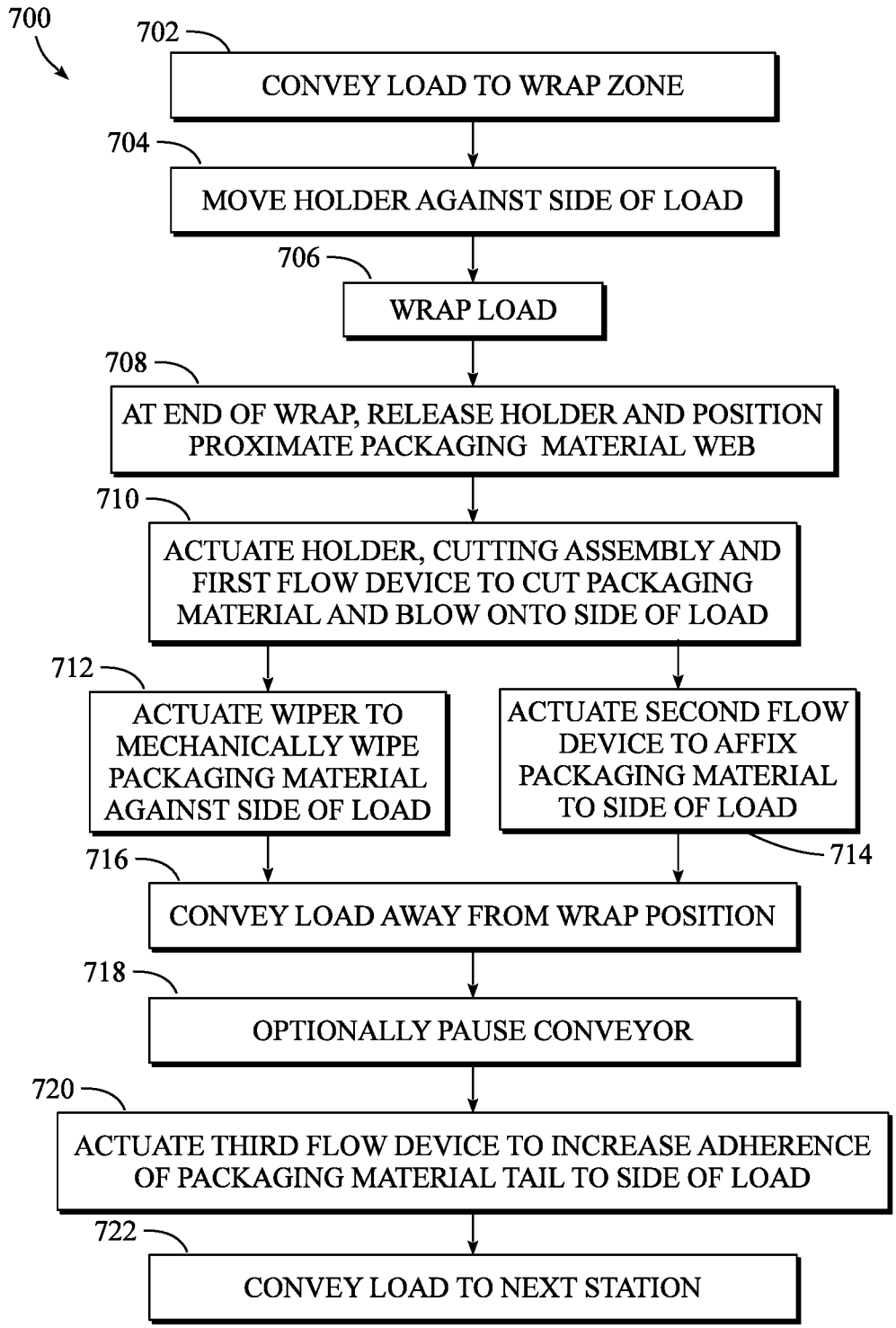
FIG. 27 is a flowchart illustrating an example sequence of operations for wrapping a load using the apparatus of FIG. 21.

FIG. 27 next illustrates an operational sequence 700 capable of being performed to wrap a load using any of the aforementioned load wrapping apparatus designs, and incorporating a tail adherence operation consistent with the invention. First, and with additional reference to FIG. 21, in block 702, load 610 is conveyed to the wrap zone, e.g., using conveyor 604. Next, in block 704, holder 616 is rotated to a position adjacent side 634 of load 610, and wrapping commences in block 706, e.g., by activating rotational drive 608 to rotate packaging material dispenser 606 around the load about axis of rotation A.

Next, at the conclusion of wrapping, holder 616 may be released and returned to its original position and the packaging material dispenser may be rotated to a rotational position that orients the packaging material web proximate the holder 616 (block 708). Then, in block 710, holder 616, cutting assembly 618 and flow device 622 are actuated to clamp the packaging material web, sever the packaging material web to form a packaging material tail, and blow or urge the packaging material tail onto the side of the load 102.

Next, depending on whether a mechanical wiping assembly is used (as in the case of the apparatus of FIG. 26) or a second flow device is used (as in the case in the apparatuses of FIGS. 21 and 25) one of blocks 712 and 714 is performed to press at least a portion of the packaging material tail against the side of the load.

Then, as illustrated in block 716 the load may be conveyed away from the wrap position, and optionally out of the wrap zone, e.g., using conveyor 604. In addition, as illustrated in block 718, the conveyor may optionally be paused to stop the load in a predetermined position (e.g., position 610' of FIG. 21) relative to flow device 626, such that the target are of flow device 626 is positioned upstream of the end of the packaging material tail. Flow device 626 is then actuated in block 720 to perform the tail adherence operation to increase the adherence of the packaging material tail to the side of the load, and the load may then be conveyed to the next station (block 722) for disposition (e.g., moved to warehouse storage or a shipping dock). Operational sequence 700 is then complete.

It will be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. An apparatus for wrapping a load, the apparatus comprising:

a packaging material dispenser configured to dispense a web of packaging material to the load;

a rotational drive configured to generate relative rotation between the packaging material dispenser and the load about a center of rotation;

a cutting assembly configured to sever the web of packaging material to form a packaging material tail extending from a corner of the load; and a flow stabilized high speed axial fan blower positioned to direct a flow of fluid towards the packaging material tail from a position generally upstream of a free end of the packaging material tail and at an acute angle relative to the side of the load while the free end of the packaging material tail is unsupported to cause the packaging material tail to come into contact with the side of the load, wherein the flow stabilized high speed axial fan blower is configured to generate the flow of fluid to have, proximate the corner of the load, a velocity of at least 10 miles per hour throughout a target area defined in a plane generally transverse to a longitudinal axis of the flow stabilized high speed axial fan blower, wherein the flow stabilized high speed axial fan blower is positioned such that the target area extends at least 3 inches on each side of the corner of the load.

2. The apparatus of claim 1, wherein the target area has a height that is at least a height of the packaging material tail proximate the corner of the load.

3. The apparatus of claim 1, wherein the flow stabilized high speed axial fan blower is configured to generate the flow of fluid to have, proximate a center of the target area, a velocity of at least 20 miles per hour, and proximate a perimeter of the target area, a velocity of at least 10 miles per hour.

4. The apparatus of claim 1, wherein the flow stabilized high speed axial fan blower is configured to generate the flow of fluid to have a velocity of at least 50 miles per hour proximate an outlet of the flow stabilized high speed axial fan blower.

5. The apparatus of claim 1, wherein the flow stabilized high speed axial fan blower is inclined upwardly at least 8 degrees.

6. The apparatus of claim 5, wherein the flow stabilized high speed axial fan blower is inclined upwardly at least 16 degrees.

7. The apparatus of claim 1, further comprising:

a rotating arm, wherein the packaging material dispenser is coupled to the rotating arm and the rotational drive is configured to generate the relative rotation between the packaging material dispenser and the load about the center of rotation by rotating the rotating arm about the center of rotation; and a base supporting the rotating arm, wherein the flow stabilized high speed axial fan blower is mounted to the base.

8. The apparatus of claim 7, wherein the base includes at least one leg and a bollard disposed proximate an end of the at least one leg, and wherein the flow stabilized high speed axial fan blower is mounted within the bollard.

9. The apparatus of claim 1, further comprising a turntable for supporting the load, wherein the rotational drive is configured to generate the relative rotation between the packaging material dispenser and the load about the center of rotation by rotating the turntable.

10. The apparatus of claim 9, wherein the flow stabilized high speed axial fan blower is mounted to a support leg disposed proximate the turntable.

11. The apparatus of claim 1, wherein the acute angle is a first angle, the position is a first position, and the flow of fluid is a first flow of fluid, the apparatus further comprising a flow device configured to direct a second flow of fluid towards the packaging material tail from a second position and at a second angle relative to the side of the load.

12. The apparatus of claim 11, wherein the flow device includes one or more nozzles coupled to a source of pressurized fluid.

13. The apparatus of claim 12, wherein the one or more nozzles are rotatably supported by a support assembly that is at least partially inside of a zone of rotation for the packaging material dispenser to rotate between a substantially horizontal storage position and a substantially vertical operating position.

14. The apparatus of claim 11, wherein the second angle is substantially orthogonal relative to the side of the load, the flow device is configured to be activated after the flow stabilized high speed axial fan blower is activated, and the flow device is configured to be activated concurrently with the packaging material tail coming into contact with the side of the load.

15. The apparatus of claim 1, wherein the flow stabilized high speed axial fan blower includes:

a housing extending along the longitudinal axis between an inlet and an outlet;

an axial fan blade disposed in the housing and configured to rotate about the longitudinal axis;

a fan motor coupled to the axial fan blade and configured to rotate the axial fan blade about the longitudinal axis at a rate at or greater than 10,000 RPM; and a plurality of stabilizing vanes extending between the axial fan blade and the outlet of the housing and configured to stabilize fluid flow downstream of the axial fan blade.

16. The apparatus of claim 15, wherein the housing is substantially cylindrical and has a length to width ratio between 1.5 to 1 and 4 to 1.

17. The apparatus of claim 15, wherein the axial fan blade includes 8 to 15 blades.

18. The apparatus of claim 15, wherein the fan motor is configured to rotate the axial fan blade at a rate at or greater than 20,000 RPM.

19. The apparatus of claim 18, wherein the fan motor is configured to rotate the axial fan blade at a rate at or greater than 40,000 RPM.

20. The apparatus of claim 15, wherein the fan motor is a variable speed DC motor.

21. The apparatus of claim 15, wherein the plurality of stabilizing vanes includes four stabilizing vanes.

22. The apparatus of claim 15, wherein each of the plurality of stabilizing vanes includes a leading edge disposed proximate the axial fan blade and a trailing edge disposed proximate the outlet of the housing such that the plurality of stabilizing vanes extend substantially throughout a space between the axial fan blade and the outlet of the housing.

23. The apparatus of claim 15, wherein each of the plurality of stabilizing vanes includes a curved leading edge that curves in a direction opposite of a direction of rotation of the axial fan blade.

24. The apparatus of claim 15, wherein the blower further comprises an inner housing extending along the longitudinal axis within the outer housing, wherein the plurality of stabilizing vanes are coupled to the inner housing.

25. The apparatus of claim 24, wherein the inner housing is substantially cylindrical.

26. The apparatus of claim 25, wherein the inner housing includes an open end facing the inlet of the outer housing and at least a portion of the fan motor is received within the open end of the inner housing.

27. The apparatus of claim 15, wherein the blower further includes a flared inlet.

28. The apparatus of claim 27, wherein a leading end of the axial fan blade is substantially even with a narrower diameter end of the flared inlet.

29. An apparatus for wrapping a load, the apparatus comprising:

a packaging material dispenser configured to dispense a web of packaging material to the load;

a rotational drive configured to generate relative rotation between the packaging material dispenser and the load about a center of rotation;

a cutting assembly configured to sever the web of packaging material to form a packaging material tail extending from a corner of the load; and a flow stabilized high speed axial fan blower positioned to direct a flow of fluid towards the packaging material tail from a position generally upstream of a free end of the packaging material tail and at an acute angle relative to the side of the load while the free end of the packaging material tail is unsupported to cause the packaging material tail to come into contact with the side of the load, wherein the flow stabilized high speed axial fan blower comprises:

an outer housing extending along a longitudinal axis between an inlet and an outlet;

an inner housing extending along the longitudinal axis within the outer housing;

an axial fan blade disposed in the outer housing and configured to rotate about the longitudinal axis;

a fan motor coupled to the axial fan blade and configured to rotate the axial fan blade about the longitudinal axis at a rate at or greater than 10,000 RPM; and a plurality of stabilizing vanes extending between the axial fan blade and the outlet of the outer housing and configured to stabilize fluid flow downstream of the axial fan blade, wherein each of the plurality of stabilizing vanes includes a leading edge disposed proximate the axial fan blade and a trailing edge disposed proximate the outlet of the outer housing such that the plurality of stabilizing vanes extend substantially throughout a space between the axial fan blade and the outlet of the outer housing and substantially along a length between opposing ends of the inner housing along the longitudinal axis.

30. The apparatus of claim 29, wherein the outer housing is substantially cylindrical and has a length to width ratio of between 1.5 to 1 and 4 to 1.

31. The apparatus of claim 29, wherein the axial fan blade includes 8 to 15 blades.

32. The apparatus of claim 29, wherein the fan motor is configured to rotate the axial fan blade at a rate at or greater than 20,000 RPM.

33. The apparatus of claim 32, wherein the fan motor is configured to rotate the axial fan blade at a rate at or greater than 40,000 RPM.

34. The apparatus of claim 29, wherein the fan motor is a variable speed DC motor.

35. The apparatus of claim 29, wherein the plurality of stabilizing vanes includes four stabilizing vanes.

36. The apparatus of claim 29, wherein each of the plurality of stabilizing vanes includes a curved leading edge that curves in a direction opposite of a direction of rotation of the axial fan blade.

37. The apparatus of claim 29, wherein the plurality of stabilizing vanes are coupled to the inner housing.

38. The apparatus of claim 37, wherein the inner housing is substantially cylindrical.

39. The apparatus of claim 38, wherein the inner housing includes an open end facing the inlet of the outer housing and at least a portion of the fan motor is received within the open end of the inner housing.

40. The apparatus of claim 29, wherein the blower further includes a flared inlet.

41. The apparatus of claim 40, wherein a leading end of the axial fan blade is substantially even with a narrower diameter end of the flared inlet.

42. An apparatus for wrapping a load, the apparatus comprising:

a packaging material dispenser configured to dispense a web of packaging material to the load;

a rotational drive configured to generate relative rotation between the packaging material dispenser and the load about a center of rotation;

a cutting assembly configured to sever the web of packaging material to form a packaging material tail extending from a corner of the load; and a flow stabilized high speed axial fan blower positioned to direct a flow of fluid towards the packaging material tail, wherein the flow stabilized high speed axial fan blower comprises:

an outer housing extending along a longitudinal axis between an inlet and an outlet;

an inner housing extending along the longitudinal axis within the outer housing;

an axial fan blade disposed in the outer housing and configured to rotate about the longitudinal axis;

a fan motor coupled to the axial fan blade and configured to rotate the axial fan blade about the longitudinal axis at a rate at or greater than 10,000 RPM; and a plurality of stabilizing vanes extending between the axial fan blade and the outlet of the outer housing and configured to stabilize fluid flow downstream of the axial fan blade, wherein each of the plurality of stabilizing vanes includes a leading edge disposed proximate the axial fan blade and a trailing edge disposed proximate the outlet of the outer housing such that the plurality of stabilizing vanes extend substantially throughout a space between the axial fan blade and the outlet of the outer housing and substantially along a length between opposing ends of the inner housing along the longitudinal axis.

43. The apparatus of claim 42, further comprising a controller coupled to the rotational drive and the flow stabilized high speed axial fan blower, wherein the controller is configured to:

activate the flow stabilized high speed axial fan blower a first time to direct a first flow of fluid towards the packaging material tail from a position generally upstream of a free end of the packaging material tail and at an acute first angle relative to the side of the load while the free end of the packaging material tail is unsupported to cause the packaging material tail to come into contact with the side of the load;

activate the rotational drive to rotate the load relative to the flow stabilized high speed axial fan blower; and after rotation of the load relative to the flow stabilized high speed axial fan blower, activate the flow stabilized high speed axial fan blower a second time and at a second angle relative to the side of the load to increase adherence of the packaging material tail to the side of the load.

44. A method of wrapping a load, the method comprising:

dispensing a web of packaging material to the load with a packaging material dispenser and generating relative rotation between the packaging material dispenser and the load about a center of rotation to wrap the web of packaging material around the load;

severing the web of packaging material to form a packaging material tail extending from a corner of the load; and directing a flow of fluid towards the packaging material tail from a position generally upstream of a free end of the packaging material tail and at an acute angle relative to the side of the load while the free end of the packaging material tail is unsupported to cause the packaging material tail to come into contact with the side of the load using a flow stabilized high speed axial fan blower, wherein the flow stabilized high speed axial fan blower is configured to generate the flow of fluid to have, proximate the corner of the load, a velocity of at least 10 miles per hour throughout a target area defined in a plane generally transverse to a longitudinal axis of the flow stabilized high speed axial fan blower, wherein the flow stabilized high speed axial fan blower is positioned such that the target area extends at least 3 inches on each side of the corner of the load.

45. The method of claim 44, wherein the flow of fluid is a first flow of fluid and the acute angle is a first angle, and wherein the method further comprises:

rotating the load relative to the flow stabilized high speed axial fan blower; and after rotation of the load relative to the flow stabilized high speed axial fan blower, activating the flow stabilized high speed axial fan blower at a second angle relative to the side of the load to increase adherence of the packaging material tail to the side of the load.

* * * * *